US008761653B2

(12) United States Patent
Maeda

(10) Patent No.: US 8,761,653 B2
(45) Date of Patent: Jun. 24, 2014

(54) IMAGE FORMING APPARATUS WITH TONER BASED CONTROL

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 145 days.

(21) Appl. No.: 13/402,130

(22) Filed: Feb. 22, 2012

(65) Prior Publication Data

US 2012/0237242 A1 Sep. 20, 2012

(30) Foreign Application Priority Data

Mar. 16, 2011 (JP) ..... 2011-058136

(51) Int. Cl.
*G03G 15/20* (2006.01)

(52) U.S. Cl.
USPC ..... 399/336

(58) Field of Classification Search
USPC ..... 399/336
See application file for complete search history.

(56) References Cited

U.S. PATENT DOCUMENTS

| | | | | |
|---|---|---|---|---|
| 7,035,556 | B2 * | 4/2006 | Behnke et al. | 399/33 |
| 7,136,601 | B2 | 11/2006 | Akizuki et al. | |
| 2004/0033084 | A1 | 2/2004 | Akizuki et al. | |
| 2010/0202790 | A1 | 8/2010 | Matsubara et al. | |
| 2011/0044741 | A1 * | 2/2011 | Matsubara et al. | 399/335 |
| 2011/0158721 | A1 * | 6/2011 | Matsubara et al. | 399/336 |

FOREIGN PATENT DOCUMENTS

| | | |
|---|---|---|
| CN | 1470956 A | 1/2004 |
| JP | 60-237481 | 11/1985 |
| JP | 07-191560 | 7/1995 |
| JP | 11-038802 | 2/1999 |
| JP | 2005-037443 | 2/2005 |
| JP | 2005-084055 | 3/2005 |
| JP | 2006-258853 | 9/2006 |
| JP | 2010-217731 | 9/2010 |

* cited by examiner

*Primary Examiner* — G. M. Hyder
(74) *Attorney, Agent, or Firm* — Renner, Otto, Boisselle & Sklar, LLP

(57) ABSTRACT

To provide an image forming apparatus in which multiple number of laser beams are controlled to perform fixing based on the toner concentration in the developing device, or based on the density and weight of the toner image adhering on the recording medium before fixing. The controller in the image forming apparatus compares the toner concentration detected by the toner concentration detector with the reference toner concentration, calculates the output level of the laser irradiator, controls the laser irradiator based on the calculation, controls to increase the output level of the laser irradiator in accordance with the detected toner concentration when the toner concentration is lower than the reference toner concentration, and controls to lower the output level of the laser irradiator in accordance with the detected toner concentration when the toner concentration is higher than the reference toner concentration.

4 Claims, 19 Drawing Sheets

*FIG. 11*

| Laser Light Output Level (W) | Toner Concentration | Fixing Performance |
|---|---|---|
| 2. 0 | 4% | × |
| | 7% | ○ |
| | 10% | ○ |
| 2. 4 | 4% | ○ |
| | 7% | ○ |
| | 10% | ○ |
| 1. 6 | 4% | × |
| | 7% | × |
| | 10% | ○ |

*FIG. 12*

| Paper Conveying Speed (mm/s) | Toner Concentration | Fixing Performance |
|---|---|---|
| 240 | 4% | × |
| | 7% | × |
| | 10% | ○ |
| 160 | 4% | ○ |
| | 7% | ○ |
| | 10% | ○ |

*FIG. 13*

| Duty Ratio | Toner Concentration | Fixing Performance |
|---|---|---|
| 83% | 4% | × |
| | 7% | ○ |
| | 10% | ○ |
| 67% | 4% | × |
| | 7% | × |
| | 10% | ○ |

*FIG. 18*

| Number of Sheets | Toner Image Density | Laser Light Output Level (W) |
|---|---|---|
| 1 | 1. 5 | 375. 0 |
| 20 | 1. 4 | 382. 5 |
| 40 | 1. 3 | 390. 0 |
| 60 | 1. 2 | 397. 5 |
| 80 | 1. 1 | 405. 0 |
| 100 | 1. 0 | 412. 5 |

FIG. 19

| Density \ Adherence | 0.4 | 0.5 | 0.6 | 0.7 |
|---|---|---|---|---|
| 1.5 | 375.0W | 385.0W | 395.0W | 405.0W |
| 1.4 | 382.5W | 395.0W | 407.0W | 420.0W |
| 1.3 | 390.0W | 405.0W | 419.0W | 435.0W |
| 1.2 | 397.5W | 415.0W | 431.0W | 450.0W |
| 1.1 | 405.0W | 425.0W | 443.0W | 465.0W |
| 1.0 | 412.5W | 435.0W | 455.0W | 480.0W |

FIG. 20

| Density \ Adherence | 0.4 | 0.5 | 0.6 | 0.7 |
|---|---|---|---|---|
| 1.5 | 0.400ms | 0.41067ms | 0.42133ms | 0.432ms |
| 1.4 | 0.408ms | 0.42133ms | 0.43413ms | 0.448ms |
| 1.3 | 0.416ms | 0.4320ms | 0.44693ms | 0.464ms |
| 1.2 | 0.424ms | 0.44267ms | 0.45973ms | 0.480ms |
| 1.1 | 0.432ms | 0.45333ms | 0.47253ms | 0.496ms |
| 1.0 | 0.440ms | 0.4640ms | 0.48533ms | 0.512ms |

FIG. 21

| Density \ Adherence | 0.4 | 0.5 | 0.6 | 0.7 |
|---|---|---|---|---|
| 1.5 | 200.00mm/s | 194.805mm/s | 189.873mm/s | 185.185mm/s |
| 1.4 | 196.078mm/s | 189.873mm/s | 184.275mm/s | 178.571mm/s |
| 1.3 | 192.308mm/s | 185.185mm/s | 178.998mm/s | 172.414mm/s |
| 1.2 | 188.679mm/s | 180.723mm/s | 174.014mm/s | 166.667mm/s |
| 1.1 | 185.185mm/s | 176.471mm/s | 169.300mm/s | 161.290mm/s |
| 1.0 | 181.818mm/s | 172.414mm/s | 164.835mm/s | 156.250mm/s |

*FIG. 22*

| Density \ Adherence | 0.4 | 0.5 | 0.6 | 0.7 |
|---|---|---|---|---|
| 1.5 | 50% | 51% | 53% | 54% |
| 1.4 | 51% | 53% | 54% | 56% |
| 1.3 | 52% | 54% | 56% | 58% |
| 1.2 | 53% | 55% | 57% | 60% |
| 1.1 | 54% | 57% | 59% | 62% |
| 1.0 | 55% | 58% | 61% | 64% |

IMAGE FORMING APPARATUS WITH TONER BASED CONTROL

This Non provisional application claims priority under 35 U.S.C. §119 (a) on Patent Application No. 2011-058136 filed in Japan on 16 Mar. 2011, the entire contents of which are hereby incorporated by reference.

BACKGROUND OF THE INVENTION (1) Field of the Invention

The present invention relates to an image forming apparatus based on electrophotography, such as a copier, printer, facsimile machine or the like, more detailedly relating to an image forming apparatus which supplies toner to a static latent image formed on a photoreceptor drum, transfers a developed toner image to a recording medium and fuses the unfixed toner image by irradiation of laser light to fix the toner image to the recording medium.

(2) Description of the Prior Art

Image forming apparatuses (e.g., printers and the like) using the electrophotographic technique, include a fixing device that fix the toner image formed on the recording medium (paper) to the paper by thermally fusing the toner image. As this fixing device, patent document 1 has disclosed a fixing device that uses laser light for fixing.

According to patent document 1 (Japanese Patent Application Laid-open H07-191560), use of a multiple number of laser beams to heat the unfixed toner compensates for insufficient fixing performance of a single laser beam configuration and enables improvement in fixing performance. This makes it possible to use inexpensive low-power laser light devices, hence provide an image forming technology with a simplified configuration of the whole apparatus.

As a fixing method that enables efficient fixing of toner without use of waste energy, a flash lamp type fixing device for image forming has been disclosed in patent document 2 (Japanese Patent Application Laid-open 2006-258853), with which the power for fixing is appropriately controlled in accordance with the toner concentration in the developing hopper.

The fixing device of patent document 1 performs fixing by controlling the laser light intensity based on the value detected by a temperature detector. However, since the toner is thermally fused instantly by the laser light, the temperature detected by the temperature detector is not the actual temperature of the toner during its being heated. That is, the laser light intensity is controlled based on the temperature of the toner after it has been heated and fused. As a result, this method cannot achieve correct feedback control and entails the problem that the power of the laser source during irradiation of laser light is consumed wastefully.

Further, since toner is a material that fuses as absorbing light and generating heat by itself, the power (energy) of the light source to be needed for laser irradiation differs depending on the absorptivity of light by the toner and the weight of the toner (the weight of the toner image adhering to the recording medium before fixing). Accordingly, it is necessary to use the energy for irradiation of laser light efficiently, taking into account the toner concentration, the weight of the unfixed toner image and the like even if the print coverage is unvaried. In the fixing device of patent document 2, the energy for irradiation of laser light is used without taking into account any factor of the unfixed toner adhering on the recording medium before fixing, so that there is the problem that waste energy is consumed when the toner is irradiated with laser light.

SUMMARY OF THE INVENTION

The present invention has been devised in view of the above circumstances, it is therefore and object of the present invention to provide an image forming apparatus in which multiple number of laser beams are controlled to perform fixing based on the toner concentration in the developing device, or based on the density and weight of the toner image adhering on the recording medium before fixing, to thereby efficiently use the energy for irradiation of laser light for fixing.

In order to solve the above problems, each configuration of the image forming apparatus according to the present invention is provided as follows.

An image forming apparatus of the present invention comprises: a fixing device including a laser irradiator emitting laser light onto a recording medium being conveyed to thermally fix an unfixed toner image onto the recording medium; a controller controlling image formation; a developing device performing development using a dual-component developer including a toner and a carrier; a toner concentration detector detecting the toner concentration in the developing device; and, a storage storing the toner concentration and a reference toner concentration, and is characterized in that the controller compares the toner concentration detected by the toner concentration detector with the reference toner concentration, calculates the output level of the laser irradiator, controls the laser irradiator based on the calculation, controls to increase the output level of the laser irradiator in accordance with the detected toner concentration when the toner concentration is lower than the reference toner concentration, and controls to lower the output level of the laser irradiator in accordance with the detected toner concentration when the toner concentration is higher than the reference toner concentration.

The image forming apparatus of the present invention is characterized in that the controller keeps the output level of the laser irradiator constant, controls the irradiation time of the laser irradiator to be longer in accordance with the detected toner concentration when the toner concentration is lower than the reference toner concentration and controls the irradiation time of the laser irradiator to be shorter in accordance with the detected toner concentration when the toner concentration is higher than the reference toner concentration.

An image forming apparatus of the present invention comprises: a fixing device including a laser irradiator emitting laser light onto a recording medium being conveyed to thermally fix an unfixed toner image onto the recording medium; a controller controlling image formation; a printing information detector acquiring printing information that determines the positions of printing on the recording medium; a weight detector arranged upstream of the fixing device for measuring the weight of the recording medium with toner adhering thereto before fixing to obtain weight information; and a storage storing the printing information and the weight information, and is characterized in that the controller controls the output of the laser irradiator based on the printing information and the weight information.

The image forming apparatus of the present invention is characterized in that the weight detector includes a density detector that detects unit toner density as the toner weight per predetermined unit area in the recording medium to acquire unit area toner density information, and the controller controls the output of the laser irradiator based on the printing information, the weight information and the unit area toner density information.

The image forming apparatus of the present invention is characterized in that the controller keeps the output level of the laser irradiator constant, controls the irradiation time of the laser irradiator to be longer in accordance with the detected unit area toner density information when the unit area toner density information is lower than a predetermined value and controls the irradiation time of the laser irradiator to be shorter in accordance with the detected unit area toner density information when the unit area toner density information is higher than a predetermined value.

According to the present invention, the image forming apparatus comprises: a fixing device including a laser irradiator emitting laser light onto a recording medium being conveyed to thermally fix an unfixed toner image onto the recording medium; a controller controlling image formation; a developing device performing development using a dual-component developer including a toner and a carrier; a toner concentration detector detecting the toner concentration in the developing device; and, a storage storing the toner concentration and a reference toner concentration, and is constructed such that the controller compares the toner concentration detected by the toner concentration detector with the reference toner concentration, calculates the output level of the laser irradiator, controls the laser irradiator based on the calculation, controls to increase the output level of the laser irradiator in accordance with the detected toner concentration when the toner concentration is lower than the reference toner concentration, and controls to lower the output level of the laser irradiator in accordance with the detected toner concentration when the toner concentration is higher than the reference toner concentration. This configuration provides excellent effect in achieving exact feedback control and in preventing waste consumption of energy upon irradiation of laser light.

According to the present embodiment, the controller of the image forming apparatus controls the conveying speed in which the recording medium is conveyed and varies the length of irradiation time of the laser irradiator, so that it is possible to omit control of the output level of the laser irradiator, hence this configuration contributes to simplification of the fixing device.

According to the present invention, the image forming apparatus comprises: a fixing device including a laser irradiator emitting laser light onto a recording medium being conveyed to thermally fix an unfixed toner image onto the recording medium; a controller controlling image formation; a printing information detector acquiring printing information that determines the positions of printing on the recording medium; a weight detector arranged upstream of the fixing device for measuring the weight of the recording medium with toner adhering thereto before fixing to obtain weight information; and a storage storing the printing information and the weight information, and is constructed such that the controller controls the output of the laser irradiator based on the printing information and the weight information. This configuration provides excellent effect in achieving exact feedback control and in preventing waste consumption of energy upon irradiation of laser light.

According to the present invention, the weight detector of the image forming apparatus of the present invention includes a density detector that detects unit toner density as the toner weight per predetermined unit area in the recording medium to acquire unit area toner density information. The controller controls the output of the laser irradiator based on the printing information, the weight information and the unit area toner density information. Accordingly, the output level of laser light used for fixing is controlled by taking into account the distribution of toner particles and the way in which toner particles adhering on the recording medium are layered, it is hence possible to make efficient use of energy.

According to the present invention, the controller of the image forming apparatus of the present invention keeps the output level of the laser irradiator constant, controls the irradiation time of the laser irradiator to be longer in accordance with the detected unit area toner density information when the unit area toner density information is lower than a predetermined value and controls the irradiation time of the laser irradiator to be shorter in accordance with the detected unit area toner density information when the unit area toner density information is higher than a predetermined value. Accordingly, this configuration provides excellent effect in achieving simple control based on the irradiation time of the laser irradiator.

BRIEF DESCRIPTION OF THE DRAWINGS

FIG. 11 is a chart showing one example of experimental data representing the evaluation on fixing performance in association with the output level of laser light and the toner concentration in the image forming apparatus according to the first embodiment;

FIG. 12 is a chart showing one example of experimental data representing the evaluation on fixing performance in association with the fixing conveyance speed and the toner concentration in the image forming apparatus of the first embodiment;

FIG. 13 is a chart showing one example of experimental data representing the evaluation on fixing performance in association with the duty ratio and the toner concentration in the image forming apparatus of the first embodiment;

FIG. 18 is a table chart representing an experimental result for finding the conditions for preferable fixing performance in association with the output level of laser light and the density of an unfixed toner image in the image forming apparatus according to the second embodiment;

FIG. 19 is a table chart representing an experimental result for finding the conditions for preferable fixing performance in association with the output level of laser light, the density of an unfixed toner image and the amount of toner adherence in the image forming apparatus according to the second embodiment;

FIG. 20 is a table chart representing an experimental result for finding the conditions for preferable fixing performance in association with the irradiation time of laser light, the density of an unfixed toner image and the amount of toner adherence in the image forming apparatus according to the second embodiment;

FIG. 21 is a table chart representing an experimental result for finding the conditions for preferable fixing performance in association with the paper conveying speed, the density of an unfixed toner image and the amount of toner adherence in the image forming apparatus according to the second embodiment;

FIG. 22 is a table chart representing an experimental result for finding the conditions for preferable fixing performance in association with the duty ratio of laser light, the density of an unfixed toner image and the amount of toner adherence in the image forming apparatus according to the second embodiment; and, FIG. 23A is a diagram showing one example with a duty ratio of 50% in the image forming apparatus according to the second embodiment

DESCRIPTION OF THE PREFERRED EMBODIMENTS

<The First Embodiment>

Figure 1:
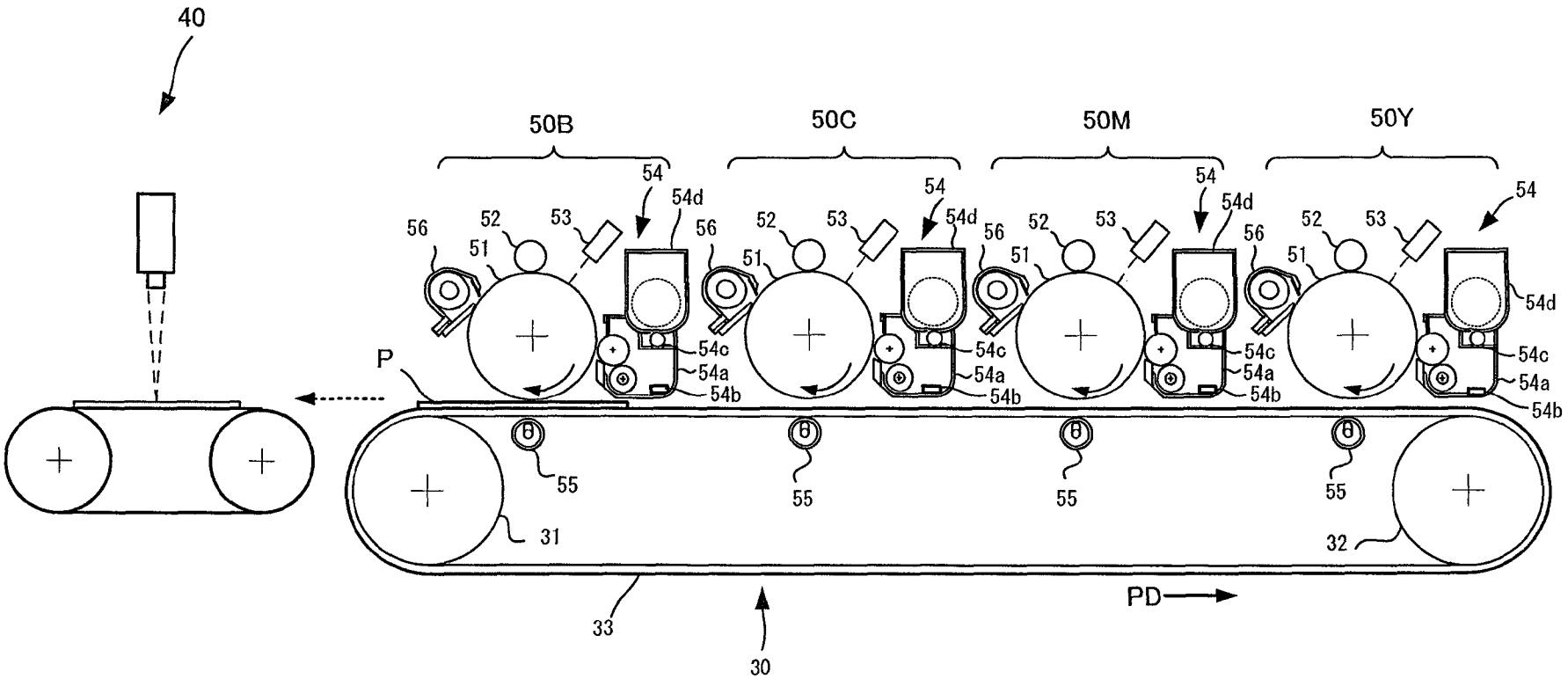
FIG. 1 is a schematic diagram showing a configuration of an image forming apparatus according to the first embodiment.
Figure 2:
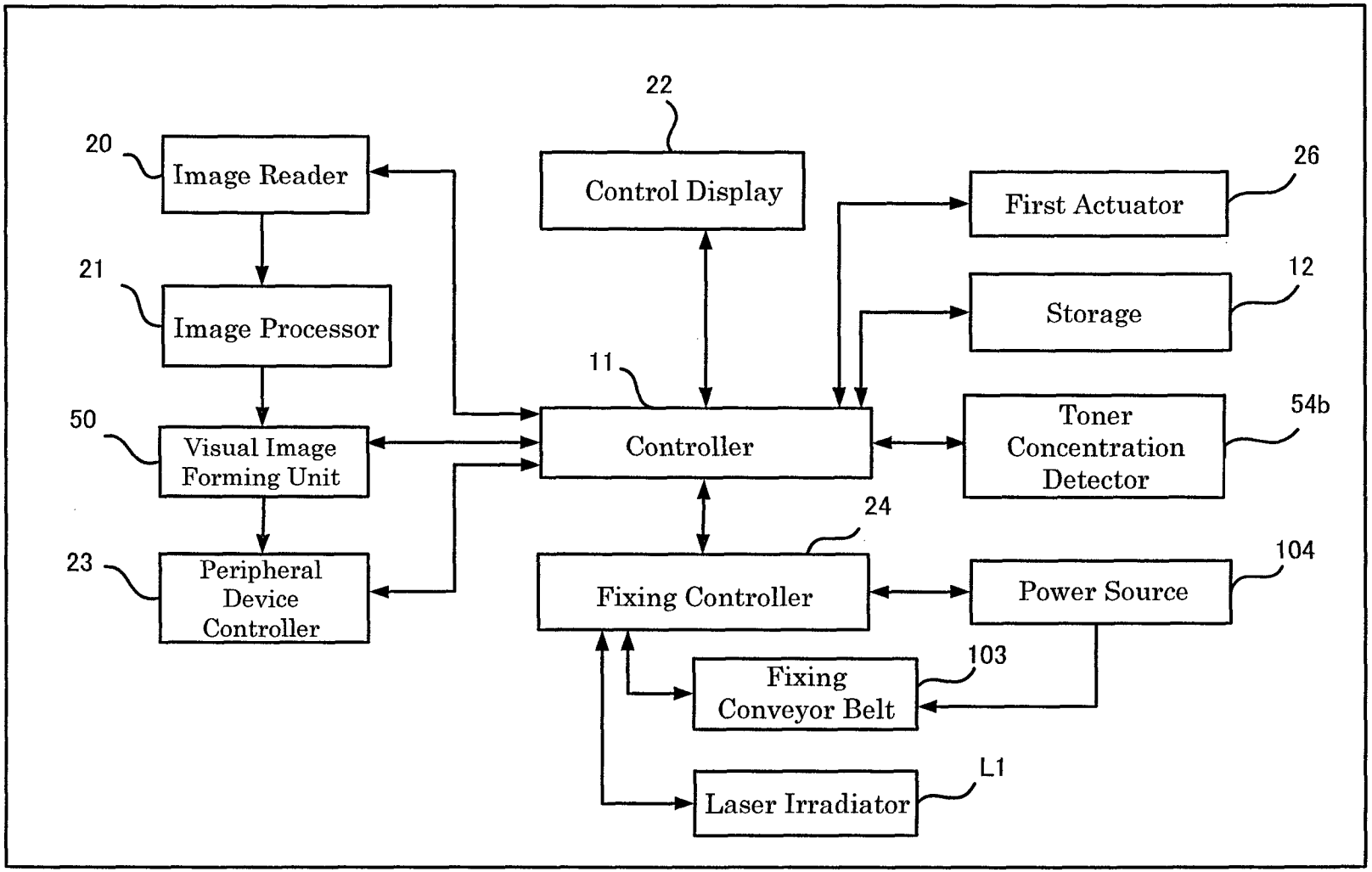
FIG. 2 is a block diagram showing a configuration of the image forming apparatus according to the first embodiment.

Next, an image forming apparatus 100 including a fixing device 40 according to the first embodiment of the present invention will be described. In the first embodiment, the image forming apparatus is applied to a color multifunctional machine. FIG. 1 is a schematic diagram showing a configuration of image forming apparatus 100 including fixing device 40 according to the first embodiment.

Since amono-component development system is not suitable for high-speed development though the system is preferable for miniaturization, a developing device 54 of a type using a dual-component developer is used in the first embodiment.

The carrier itself in the dual-component developer is not consumed but remains inside the developer without reduction, whereas the toner is used and reduced by developing operation. For this reason, in order to prevent instability of image quality due to decrease of the toner forming the dual-component developer, toner concentration control by supplying toner as appropriate is performed so as to keep the toner concentration or the composition ratio between the carrier and the toner within a proper range.

Formed on the top of a developing vessel 54*a* is an opening 54*c* that opens and closes to supply toner into developing vessel 54*a*. A toner supply device 54*d* for supplying fresh toner is arranged over opening 54*c*. Toner supply device 54*d* supplies toner to developing device 54 through opening 54*c* in accordance with the instruction from a controller 11.

A magnetic permeability sensor (toner concentration detector) 54*b* is disposed on the bottom of developing vessel 54 under opening 54*c*. Magnetic permeability sensor 54*b* detects the concentration (mixture ratio) of toner and carrier in the dual-component developer and the remaining amount of the toner. When the toner concentration is high, a large amount of toner adheres to the magnetized carrier so that the amount of magnetic material in unit volume of the developer reduces. As a result, magnetic permeability sensor 54*b* detects a low voltage level. On the other hand, a supply of toner, i.e., whether toner has fallen or not, is detected based on the change of the output level from magnetic permeability sensor 54*b* when toner has been supplied.

Controller 11, by monitoring the level of output voltage from magnetic permeability sensor 54*b*, can detect the presence or absence of toner falling based on the change in output voltage level from magnetic permeability sensor 54*b*.

Controller 11 controls the operation of image forming apparatus 100. Controller 11 is made up of a microcomputer, ROM (Read Only Memory) that stores control programs that give processing sequences to be executed by the microcomputer, RAM (Random Access Memory) that offers a work area for operation, an EEPROM (Electronically Erasable Programmable ROM) non-volatile memory for temporarily storing calculated total toner supply time, input circuits which include input buffers, A/D converting circuits, for receiving signals from switches (not shown) and output circuits which include drivers for driving motors, solenoids, lamps and others. The above storing devices are collectively called a storage 12. Here, storage 12 stores a laser irradiator table for determining the output level of an aftermentioned laser irradiator L1.

Figure 3:
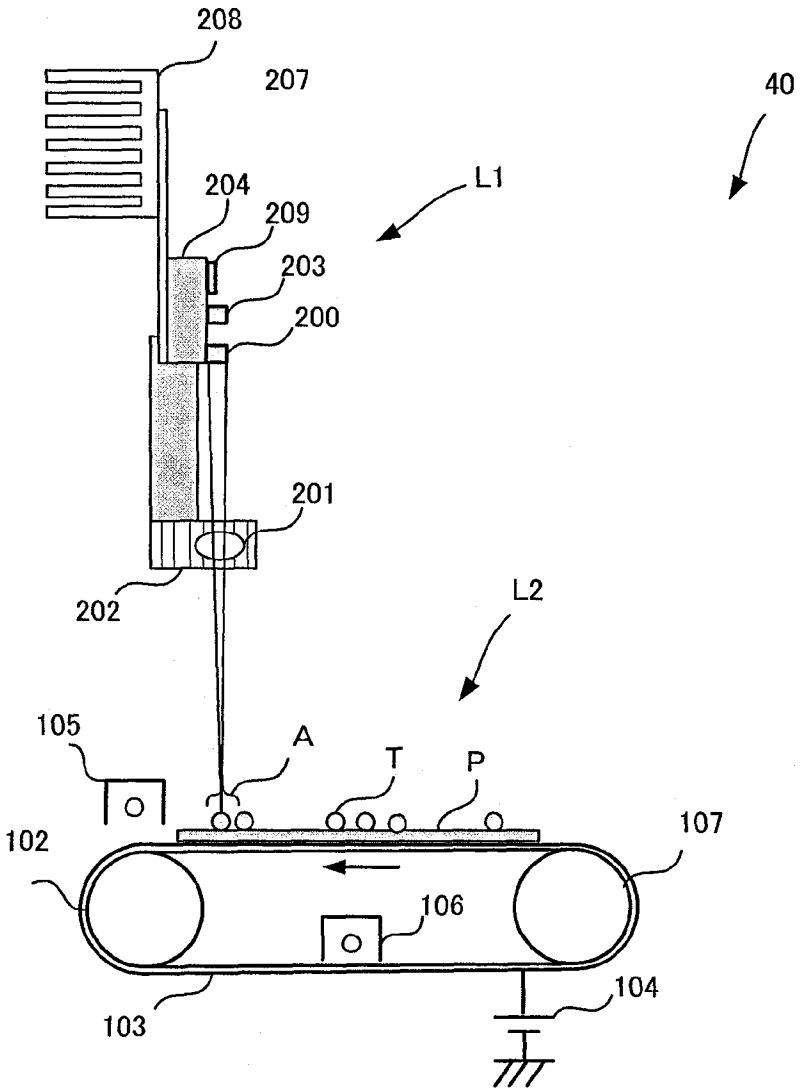
FIG. 3 is a schematic diagram showing a configuration of a fixing device of the image forming apparatus according to the first embodiment.

Referring next to FIG. 3, fixing device 40 according to the first embodiment will be described. Fixing device 40 includes, as shown in FIG. 3, a laser irradiator L1, a paper conveying system L2 and an unillustrated temperature detector (thermistor). Fixing device 40 according to the present embodiment fixes the unfixed toner image formed on the surface of a recording medium (paper P) to the recording medium by applying heat to the unfixed toner image.

Specifically, based on the predetermined fixing conveyance speed, the recording medium (paper P) bearing an unfixed toner image is conveyed through the area (laser irradiation area A) where laser light is irradiated on paper conveying system L2, and irradiated with laser light from laser irradiator L1 of fixing device 40 so that the toner image is fixed by heat from laser light.

The unfixed toner image is formed with a dual-component developer including a non-magnetic toner and a carrier. Since color toners (yellow, magenta and cyan) are lower in absorptivity of laser light compared to monochrome toner (black), an infrared absorbent is added so as to ensure the Paper conveying system L2 includes a fixing drive roller 102, a fixing driven roller 107, a power source 104, a separation charger 105, an erasing charger 106, separation claws (not shown), a first actuator 26, a fixing unit motor (not shown), a fixing controller 24 and a fixing conveyor belt 103.

Fixing conveyor belt 103 is an endless belt composed of a resin such as polycarbonate, vinylidene fluoride, polyimide or the like in which conductive materials such as carbon and the like are dispersed. Fixing conveyor belt 103 is tensioned between fixing drive roller 102 and fixing driven roller 107.

Drive of the fixing unit motor (not shown) is controlled by signals from fixing controller 24. The paper conveying speed of fixing conveyor belt 103 is made variable by this control so that the speed can be adjusted arbitrarily depending on conditions. In the present invention, the paper conveying speed is set at 200 mm/s.

Fixing drive roller 102 is connected to the fixing unit motor so as to be rotated in accordance with the designated paper conveying speed.

Arranged around fixing conveyor belt 103 are power source 104, separation charger 105, erasing charger 106 and separation claws (not shown).

A temperature detector (not shown) for detecting the temperature of fixing conveyor belt 103 is laid out on the interior surface side of fixing conveyor belt 103. The temperature detected by this temperature detector is conveyed to fixing controller 24. The position of the temperature detector is not limited to the interior surface side of fixing conveyor belt 103 as long as it can correctly detect the temperature of fixing conveyor belt 103 or the temperature of the recording medium (paper P).

Next, the fixing operation in fixing device 40 of the present invention will be specifically described with reference to FIG. 3.

In fixing device 40, the recording medium (paper P) bearing the unfixed toner image, fed from an intermediate transfer belt unit 30, is conveyed to fixing conveyor belt 103 on fixing driven roller 107.

First actuator 26 detects paper P being conveyed over fixing conveyor belt 103, at the same time detects the paper conveying speed of fixing conveyor belt 103. As first actuator 26 detects paper P, it transmits a paper detection signal to controller 11. Controller 11 transmits an instruction signal (fixing start signal) to start fixing to fixing controller 24.

Power source 104 applies a bias voltage to the fixing conveyor belt so as to statically attract paper P to fixing conveyor belt 103, whereby adhesion between paper P and fixing conveyor belt 103 is improved so as to inhibit paper P from floating from the fixing conveyor belt.

Paper P is conveyed to laser irradiation area A by the drive of fixing drive roller 102. Paper P carries an unfixed toner image thereon.

Storage 12 has stored in advance a laser irradiator table for determining the output level of laser irradiator L1. Storage 12 stores time from when fixing controller 24 receives the fixing start signal transmitted from controller 11 until the paper P with an unfixed toner image thereon reaches laser irradiation area A of fixing device 40, for each fixing conveyance speed.

Controller 11 obtains the toner concentration in developing vessel 54*a* of developing device 54 from toner concentration detector 54*b* (magnetic permeability sensor). Controller 11 refers to the laser irradiator table in storage 12. Controller 11, based on the positional information on printing transmitted from an image processor 21 and the toner concentration in developing vessel 54*a* of developing vessel 54, determines the output level of laser irradiator L1. Controller 11 transmits a control signal (fixing start signal) to fixing controller 24 so as to output laser light from laser irradiator L1 based on the determined output level.

Fixing controller 24 having received the control signal (fixing start signal) controls the output level of laser light to be emitted from laser irradiator L1. Fixing controller 24 may be configured so as to control the fixing unit motor (not shown) to set up an appropriate paper conveying speed to thereby control laser light to be irradiated. Further, storage 12 has been stored in advance with drive time ratio (duty ratio) of laser light emitted from laser irradiator L1 in correspondence with positional information on printing and toner concentration so that fixing controller 24 can control the output level of laser light emitted from laser irradiator L1 based on the duty ratio.

Laser irradiator L1 emits laser light on the unfixed toner image on paper P in accordance with the control from fixing controller 24. Fixing is performed by heat of the laser light.

After fixing the toner image in laser irradiation area A, paper P being statically attracted to fixing conveyor belt 103, is conveyed into between separation charger 105 and fixing driver roller 120.

Fixing drive roller 102 is formed of a conductive material and grounded. Accordingly, electricity on paper P is erased by separation charger 105 so as to weaken static attraction between fixing conveyor belt 103 and paper P.

Fixing conveyor belt 103 whose static attraction has been weakened is conveyed by the drive of fixing drive roller 102. Fixing conveyor belt 103 has a large curvature so that the leading end of paper P floats from fixing conveyor belt 103. Further, the paper P is completely separated from fixing conveyor belt 103 by the function of separation claws (not shown).

Fixing conveyor belt 103 from which paper P has been separated is cleared of electricity on the exterior and interior surfaces by erasing charger 106. Thereafter, bias voltage is applied to fixing conveyor belt 103 once again by power source 104, so that a next sheet of paper P is attracted to fixing conveyor belt 103.

Next, laser irradiator L1 of fixing device 40 will be described with reference to FIGS. 3 and 4.

Laser irradiator L1 irradiates the unfixed toner image borne on the recording medium (paper P) being conveyed in laser irradiation area A on fixing conveyor belt 103 so as to fix the toner image onto the recording medium.

Figure 4:
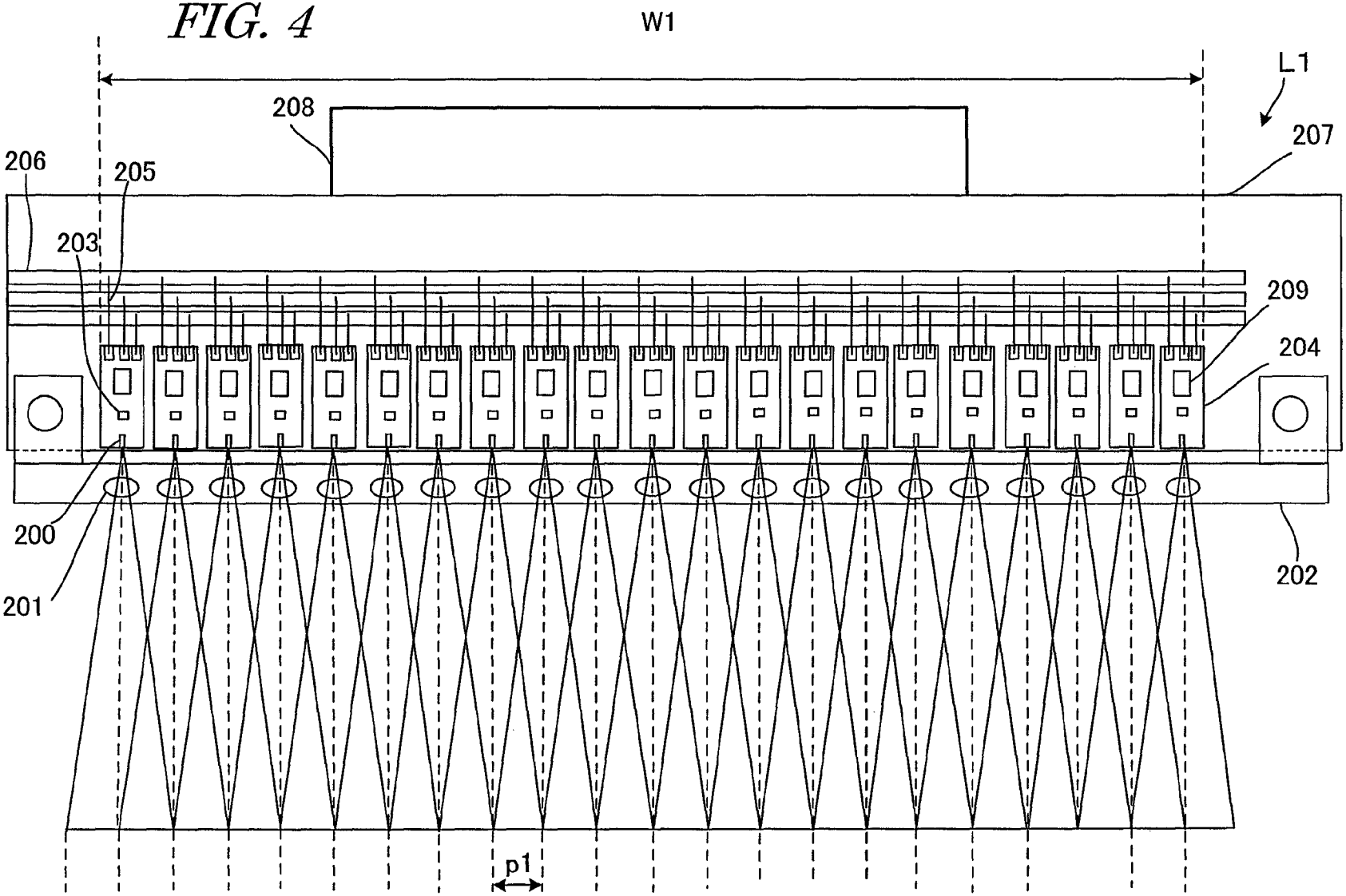
FIG. 4 is a schematic diagram showing a configuration of a laser irradiator of a fixing device of the image forming apparatus according to the first embodiment.

As shown in FIGS. 3 and 4, laser irradiator L1 includes a multiple number of laser elements 200 (a semiconductor laser array), a multiple number of convex lenses 201, a lens holder 202, photodiodes 203, silicon substrates 204, wire-bonding lines 205, surface electrodes 206, a ceramic board 207, heat-radiating plate 208 (heat sink), temperature sensors 209 (thermistor) and laser control circuits (not shown).

Heat-radiating plate 208 (heat sinker) according to the present embodiment is made of aluminum alloy. Heat-radiating plate 208 (heat sink) used herein has a total thermal resistance of 0.16 deg. C/W, formed by arraying 10 pieces of 16 deg. C/W thermal resistance in a row. However, the heat-radiating plate should not be limited to this.

As shown in FIG. 4, a light receiving element (photo diode 203) is arranged close to each laser element 200 so as to detect the light intensity of laser element 200. The light intensity detected by photo diode 203 is fed back to the laser control circuit (not shown) in laser irradiator L1 so as to adjust the output of the light intensity of each laser element 200 or keep it constant.

The laser control circuit and photo diode 203 are integrally (monolithically) formed to construct silicon substrate 204, to which laser element 200 is mounted. Laser element 200 and silicon substrate 204 are electrically connected by wire-bonding lines 205.

The temperature sensor (thermistor) for measuring the temperature of each laser element 200 is provided on silicon substrate 204. Here, the control circuit may be configured so as to change the output of the light intensity of each laser element 200 based on the temperature detected by the temperature sensor.

A multiple number of silicon substrates 204 each having laser element 200 mounted thereon are arrayed on ceramic board 207 formed of ceramics. The electrodes (not shown) of multiple silicon substrates 204 are electrically connected to surface electrodes 206 on ceramic board 207, by wire-bonding or the like.

Multiple convex lenses 201 of a condensing optical system are arrayed in lens holder 202. The laser beam emitted from each laser element 200 passes through the associated convex lens 201 and irradiates paper P on laser irradiation area A.

As described above, laser irradiator L1 is configured of ceramic board 207 on which multiple silicon substrates 204 with laser element 200 mounted thereon are arrayed, heat-radiating plate 208 (heat sink) and lens holder 202 with multiple convex lenses 201 arrayed thereon.

For laser irradiator L1, it is preferable to use a lens array such as a one-piece resin-molded lens-lens holder, a flat plate micro-lens array that is produced by shaping lenses on a flat glass plate by ion exchange, and the like, instead of assembling each convex lens 201 into the holder formed of resin. It is also possible to provide a configuration in which laser beams in their parallel state are made to irradiate the unfixed toner image, without use of any multiple convex lenses 201 as a condensing optical system.

As shown in FIG. 4, when an unfixed toner image is fixed onto a sheet of paper of a predetermined size (e.g., A4 size paper), multiple laser elements 200 arranged in a row (area W1 indicated in FIG. 4) are used. Multiple laser elements 200 are arranged in a row parallel to the width direction of fixing conveyor belt 103 and perpendicular to the paper conveying direction.

Specifically, the laser elements arranged in the laser element array area (area W1) each emit a laser beam having a wavelength of 780 mm and are arrayed with a pitch P1 of 1.0 mm. Each laser element outputs a rated power of 2.0 W and forms a laser spot having a diameter of 0.3 mm on laser irradiation area A. The wavelength of the laser element should not be limited to the above value, but can be selected from a range of 400 nm to 1,000 nm by varying the compositions, materials and the like of the semiconductor device.

As a method of controlling the output of each laser element 200 in laser irradiator L1, it is also possible to fix the unfixed toner image by controlling the irradiation time of laser light to irradiate the unfixed toner image based on a signal (ON•OFF pulse signal) for turning on and off the output of laser light.

Figure 6:
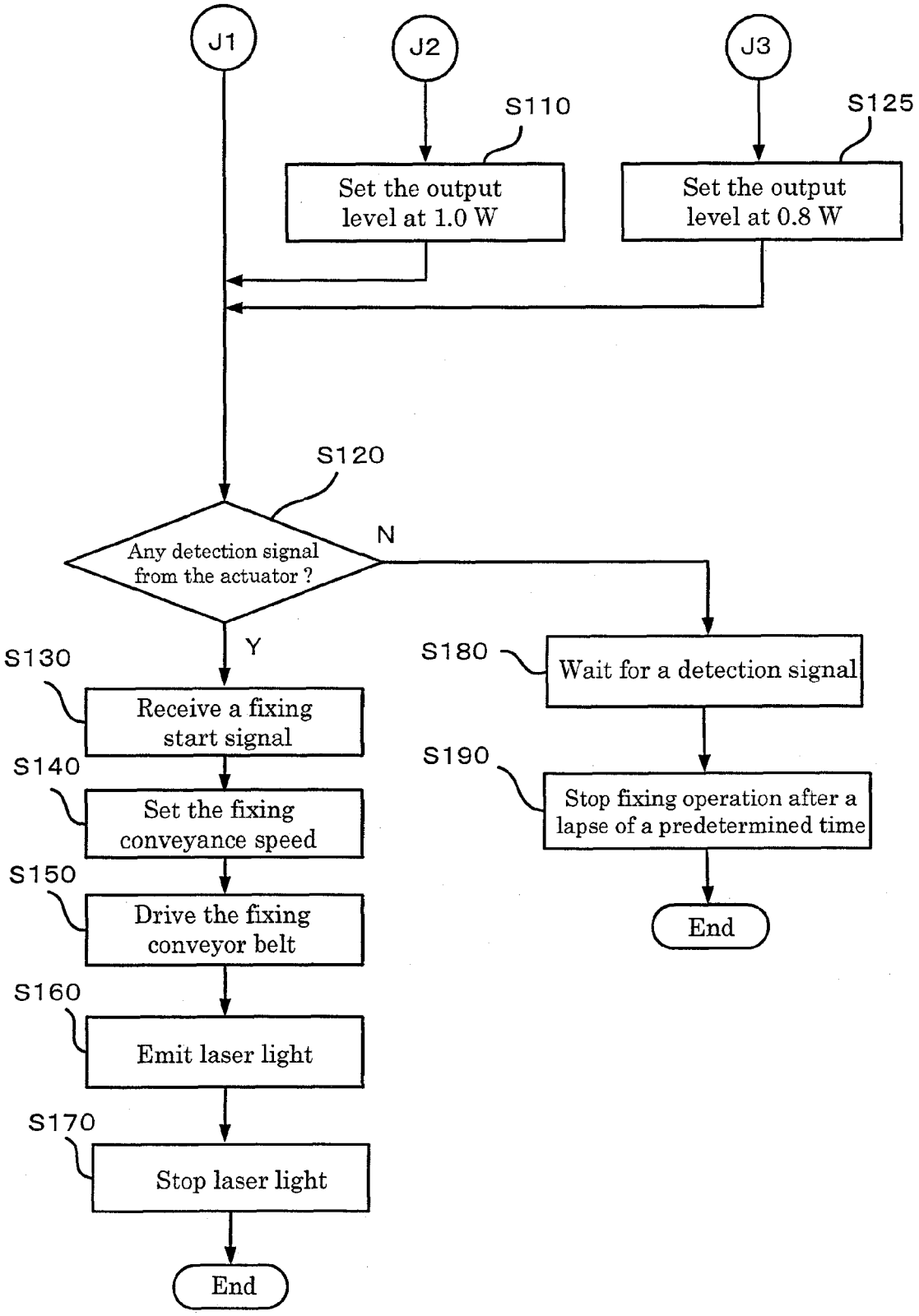
FIG. 6 is a flow chart showing the second half of the operation of fixing control in accordance with the output level of laser light in the image forming apparatus according to the first embodiment.

Next, fixing control based on toner concentration in developing device 54 will be described. FIG. 6 shows a flow chart showing fixing control based on toner concentration.

When printing is started by the user operating a control display unit 22, the document to be printed is read by an image reader 20 and converted into appropriate electric signals by means of image processor 21 to prepare color separations of image data (Step 10).

Then, image processor 21 transmits information on printed positions (positional information on printing) for specifying the positions in each page of sheet at which the read image data is to be printed, to controller 11 (Step 20).

Controller 11 acquires toner concentration information (toner concentration Tn) from toner concentration detector 54*b* (magnetic permeability sensor) inside developing device 54 (Step 30).

Controller 11 determines whether the acquired toner concentration Tn is 4% or higher (Step 40). If toner concentration Tn is 4% or higher (Step 40, Y), then controller 11 determines whether toner concentration Tn is 10% or lower (Step 60).

On the other hand, if toner concentration Tn is not 4% or higher (Step 40, N), controller 11 transmits a waiting signal for instruction fixing controller 24 to wait until the toner concentration becomes equal to 4% or higher, to fixing controller 24 (Step 50). At the same time, controller 11 transmits a supply signal to toner supply device 54*d* so that the toner supply device will supply a predetermined amount of toner to the developing device 54 through opening 54*c*. Here, the amount of toner to be supplied has been stored beforehand in storage 12, in association with each level of toner concentration.

When it has been confirmed that toner concentration Tn is 4% or higher (Step 40, Y) and if toner concentration Tn is equal to 10% or lower (Step 60, Y), controller 11 determines whether toner concentration Tn falls within the range from 4% to lower than 6% (Step 80).

On the other hand, when it has been confirmed that toner concentration Tn is 4% or higher (Step 40, Y) and if toner concentration Tn is not equal to 10% or lower (Step 60, N), controller 11 transmits a waiting signal for instruction fixing controller 24 to wait until the toner concentration becomes equal to 10% or lower, to fixing controller 24 (Step 70). At the same time, controller 11 transmits a consumption signal to developing device 54 so as to consume a predetermined amount of toner in developing device 54.

Next, when toner concentration Tn falls within the range from 4% to lower than 6% (Step 80, Y), controller 11 transmits a signal to fixing controller 24 so as to set the output level of laser irradiator L1 at 1.2 (Step 90).

On the other hand, when toner concentration Tn does not fall within the range from 4% to lower than 6% (Step 80, N), controller 11 determines whether toner concentration Tn falls within the range from 4% to lower than 8% (Step 100). When toner concentration Tn falls within the range from 4% to lower than 8% (Step 100, Y), the control goes through Jump J2 in FIG. 6 and controller 11 transmits a signal to fixing controller 24 so as to set the output level of laser irradiator L1 at 1.0 (Step 110).

On the other hand, when toner concentration Tn does not fall within the range from 4% to lower than 8% (Step 100, N) the controls goes through Jump J3 in FIG. 6 and controller 11 transmits a signal to fixing controller 24 so as to set the output level of laser irradiator L1 at 0.8 (Step 125).

Next, controller 11 determines whether there is a paper detection signal from first actuator 26 (Step 120).

When controller 11 detects a paper detection signal from first actuator 26 (Step 120, Y), controller 11 transmits an instruction signal to start fixing (fixing start signal), to fixing controller 24 (Step 130).

When receiving no paper detection signal from first actuator 26 (Step 120, N), controller 11 sets into a waiting mode to wait for a paper detection signal (Step 180). Further, when a lapse of a predetermined period of time is confirmed on an unillustrated counter in controller 11, fixing operation is stopped (Step 190).

When receiving a fixing start signal, fixing controller 24 sets the paper conveying speed of the fixing conveyor belt (Step 140) and drives fixing conveyor belt 103 (Step 150).

At the same time, fixing controller 24 controls laser irradiator L1 so as to emit laser light based on the set laser light output level, causes laser irradiator L1 to emit laser light (Step 160) and stops laser irradiation after completion of fixing (Step 170).

As described above, in accordance with the detected toner concentration, the output level of laser irradiator L1 of the fixing device is controlled so as to perform energy control for fixing the unfixed toner image. The energy E for fixing (unit: Joule (J)) is calculated as E=W·T or by multiplying the output level W (unit: watt (W)) of laser light irradiated on the unfixed toner image by irradiation time T of laser light (unit: time: sec.).

By changing the irradiation time T of laser light while keeping the output level W of irradiating laser light constant, it is also possible to control the energy E for fixing the unfixed toner image. As a method of varying irradiation time T of laser light, irradiation time T of laser light is varied by changing the paper conveying speed while the output level W of irradiating laser light kept constant.

Next, fixing control based on paper conveying speed S inside fixing device 40 will be explained. That is, description will be made on a method of controlling energy E for fixing an unfixed toner image by changing irradiation time T of laser light irradiating the unfixed toner image by changing the paper conveying speed while keeping the output level W of irradiating laser light constant.

Drive of the fixing unit motor (not shown) is controlled by signals from fixing controller 24. This control makes it possible to change and adjust the paper conveying speed of fixing conveyor belt 103.

Paper conveying speed S is represented by the distance L by which the paper passes through laser irradiation area A, divided by irradiation time T of laser light (Step=L/T).

Figure 5:
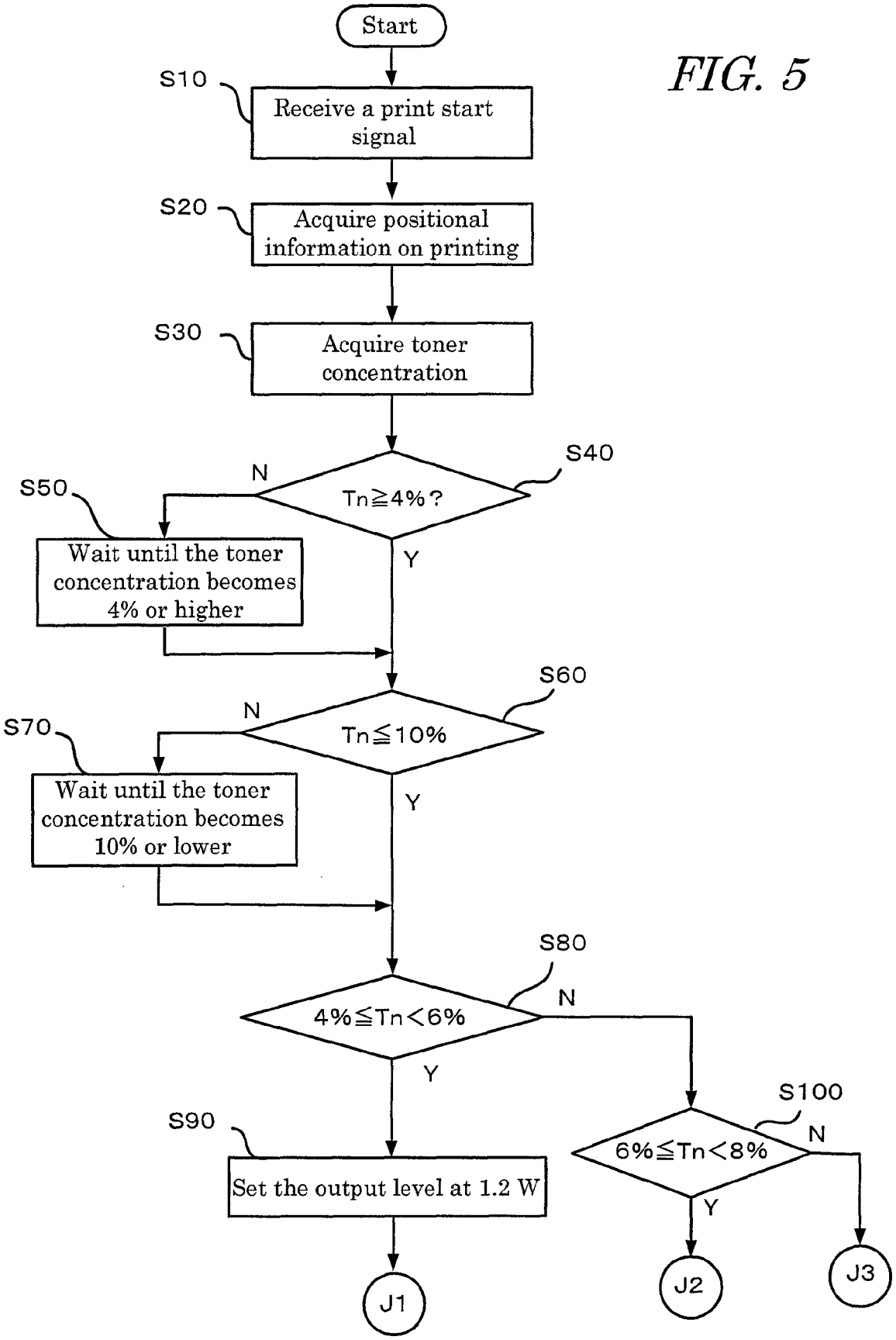
FIG. 5 is a flow chart showing the first half of the operation of fixing control in accordance with the output level of laser light in the image forming apparatus according to the first embodiment.
Figure 7:
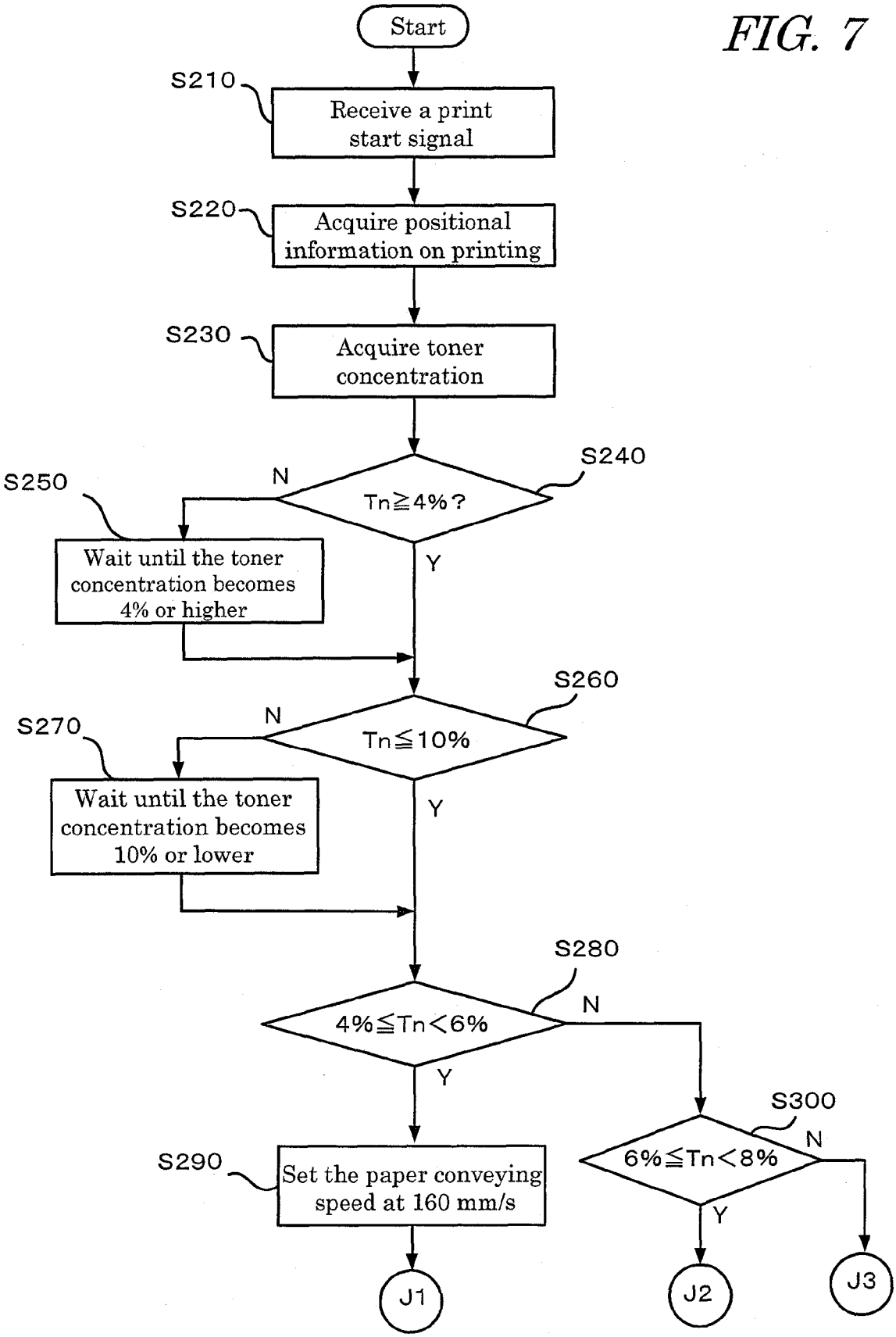
FIG. 7 is a flow chart showing the first half of the operation of fixing control in accordance with the paper conveying speed in the image forming apparatus according to the first embodiment.
Figure 8:
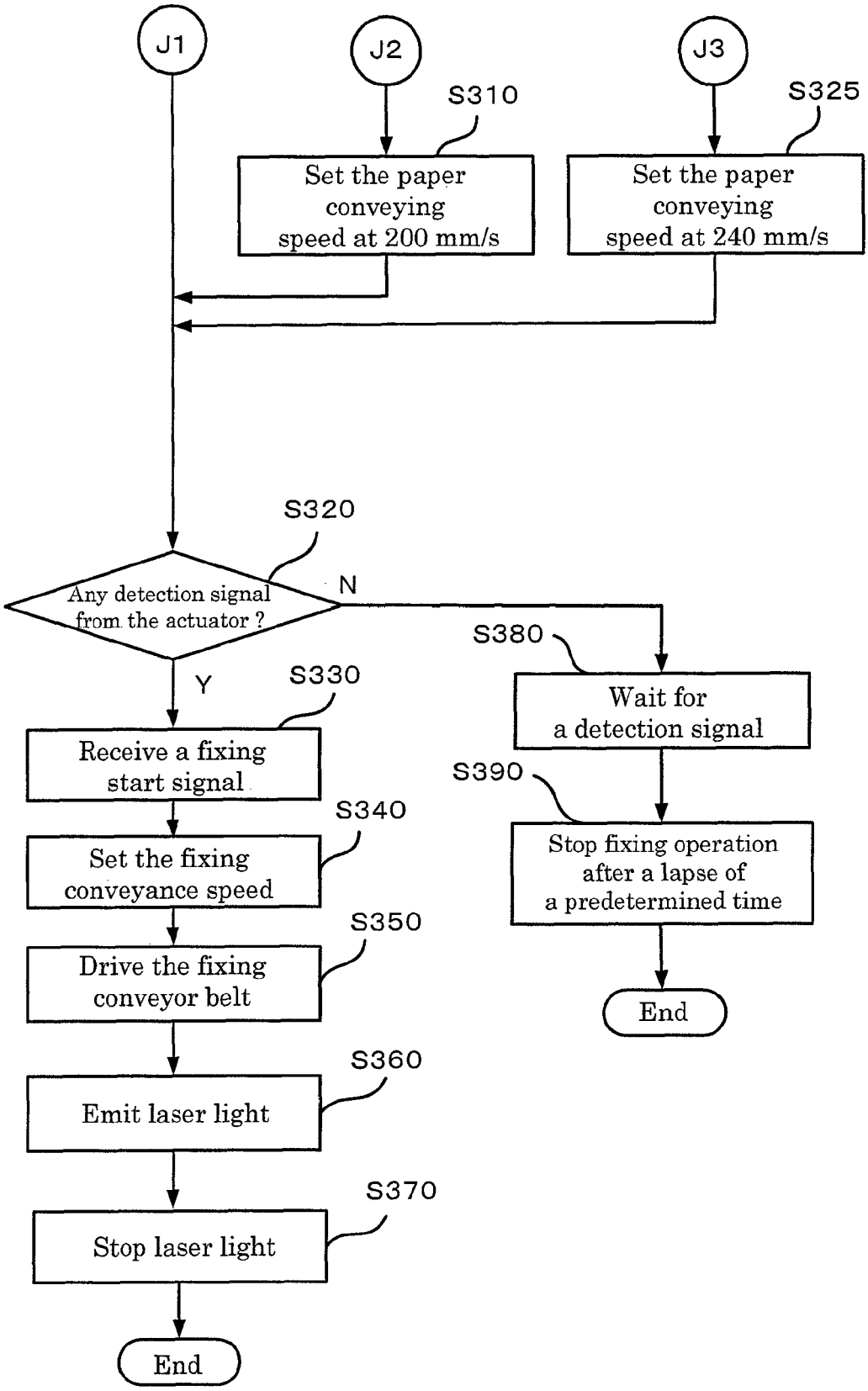
FIG. 8 is a flow chart showing the second half of the operation of fixing control in accordance with the paper conveying speed in the image forming apparatus according to the first embodiment.

FIGS. 7 and 8 show a flow chart of fixing control based on paper conveying speed S . The point of the flow chart herein different from the flow chart of the fixing control based on toner concentration shown in FIGS. 5 and 6, resides in Steps 290 to 325. Since the other control is the same as that of the flow chart of the fixing control based on toner concentration shown in FIGS. 5 and 6, description is omitted.

When toner concentration Tn falls within the range from 4% to lower than 6% (Step 280, Y), controller 11 transmits a signal to fixing controller 24 so as to set the paper conveying speed at 160 mm/s (Step 290).

On the other hand, when toner concentration Tn does not fall within the range from 4% to lower than 6% (Step 280, N), controller 11 determines whether toner concentration Tn falls within the range from 4% to lower than 8% (Step 300). When toner concentration Tn falls within the range from 4% to lower than 8% (Step 300, Y), the control goes through Jump J2 in FIG. 7 and controller 11 transmits a signal to fixing controller 24 so as to set the paper conveying speed at 200 mm/s (Step 310).

On the other hand, when toner concentration Tn does not fall within the range from 4% to lower than 8% (Step 300, N), the controls goes through Jump J3 in FIG. 7 and controller 11 transmits a signal to fixing controller 24 so as to set the paper conveying speed at 240 mm/s (Step 325).

In the above way, it is possible to control the energy E to be applied to fix the unfixed toner image by changing the paper conveying speed in accordance with the toner concentration.

It is also possible to control the energy E to be applied to fix the unfixed toner image by changing the drive time ratio (duty ratio) of the laser irradiator so as to change the irradiation time T of laser light while keeping the output level W of irradiating laser light and the fixing conveyance speed constant.

Next, fixing control based on the drive time ratio (duty ratio) of the laser irradiator in fixing device 40 will be explained. That is, description will be made on a method of controlling energy E for fixing an unfixed toner image by changing irradiation time T of laser light irradiating the unfixed toner image by changing the duty ratio of the laser irradiator while keeping the output level W of irradiating laser light and the fixing conveyance speed constant.

Figure 23A:
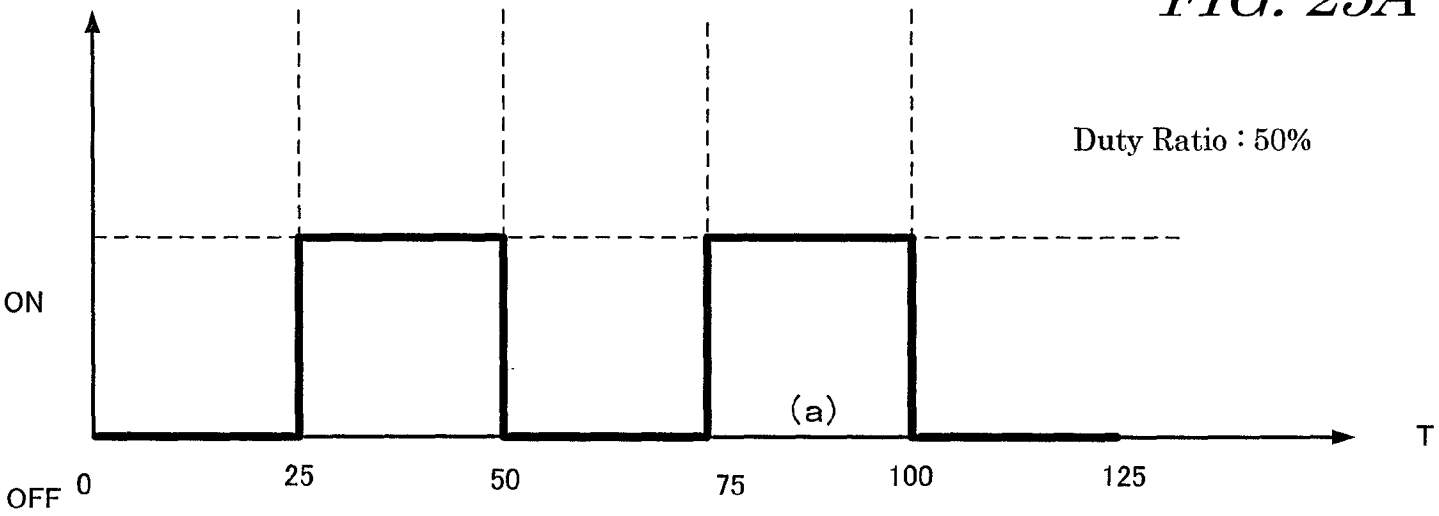
FIG. 23B is a diagram showing one example with a duty ratio of 25% in the image forming apparatus according to the second embodiment.
Figure 23B:
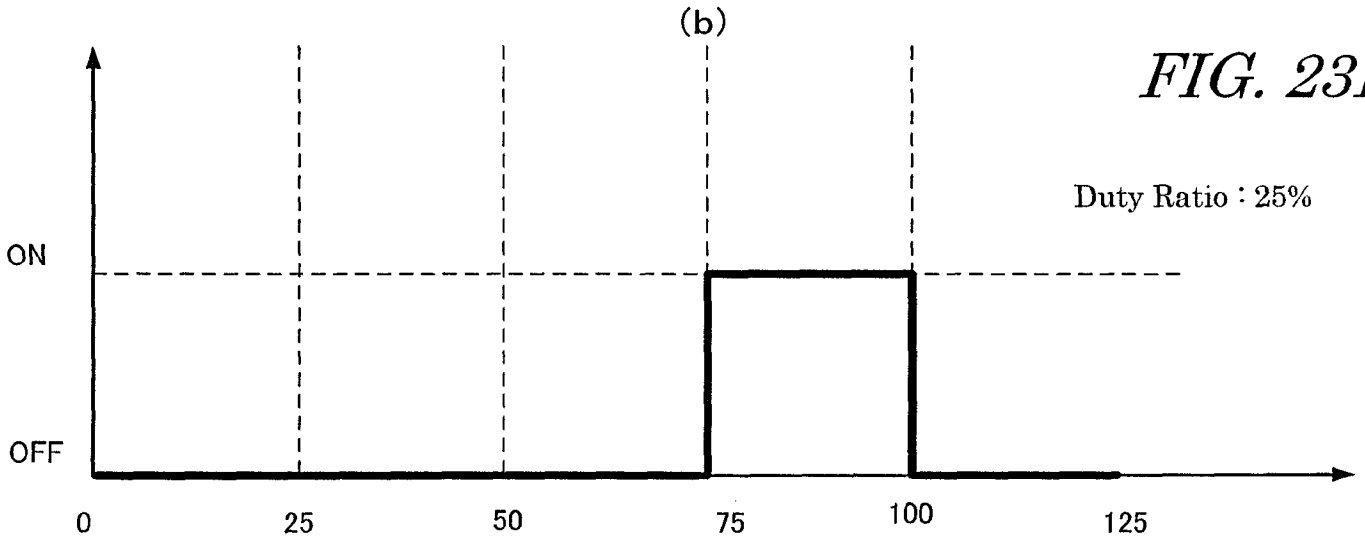

Storage 12 stores in advance the duty ratio of laser light emitted from laser irradiator L1, based on positional information on printing and toner concentration. Fixing controller 24, based on the duty ratio, controls the laser light emitted from laser irradiator L1. Here, the duty ratio indicates the temporal ratio (drive time ratio) of the output level of laser light being turned on to a predetermined time period, as shown in FIGS. 23A and 23B.

Figure 9:
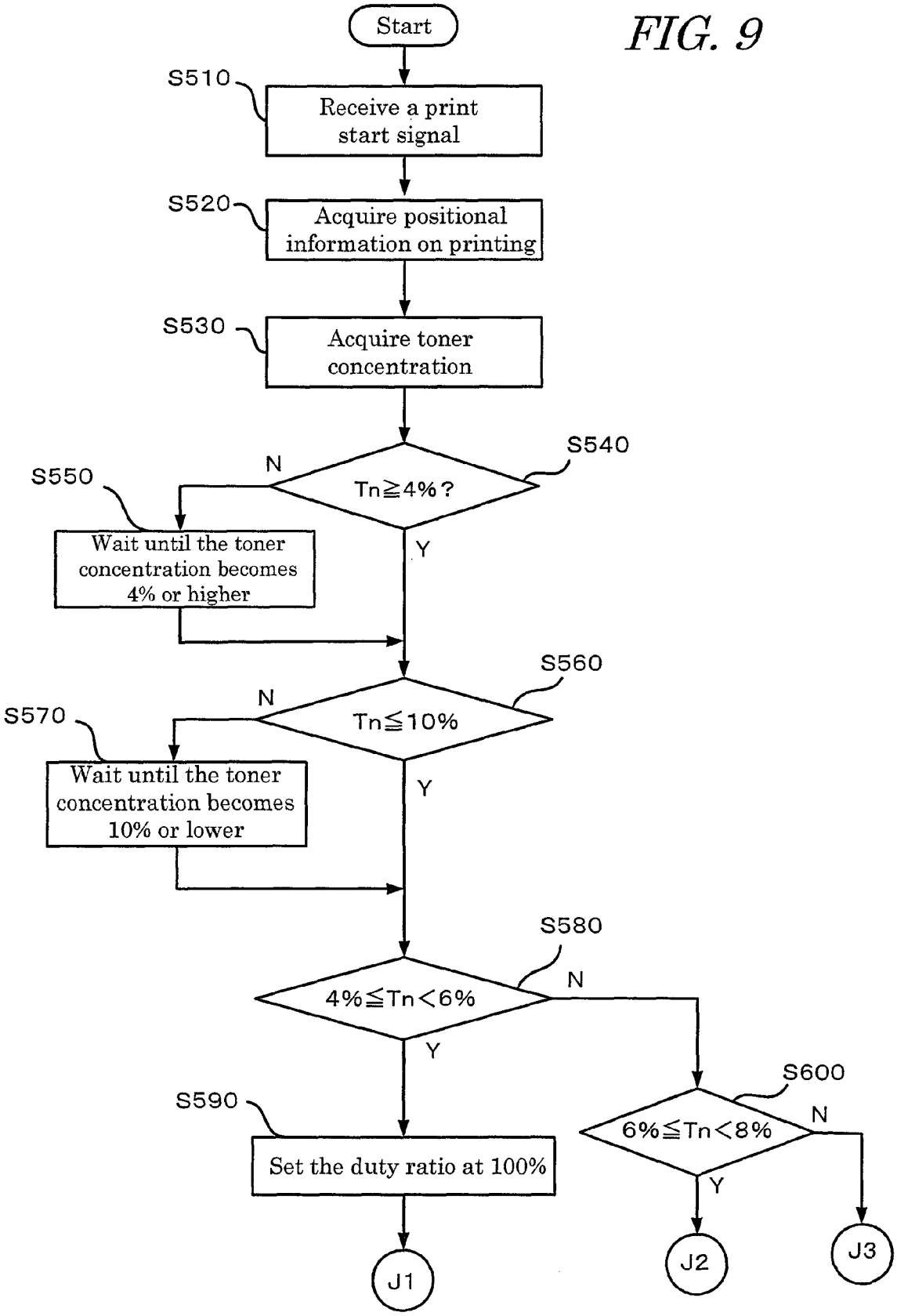
FIG. 9 is a flow chart showing the first half of the operation of fixing control in accordance with the duty ratio in an image forming apparatus according to the first embodiment.
Figure 10:
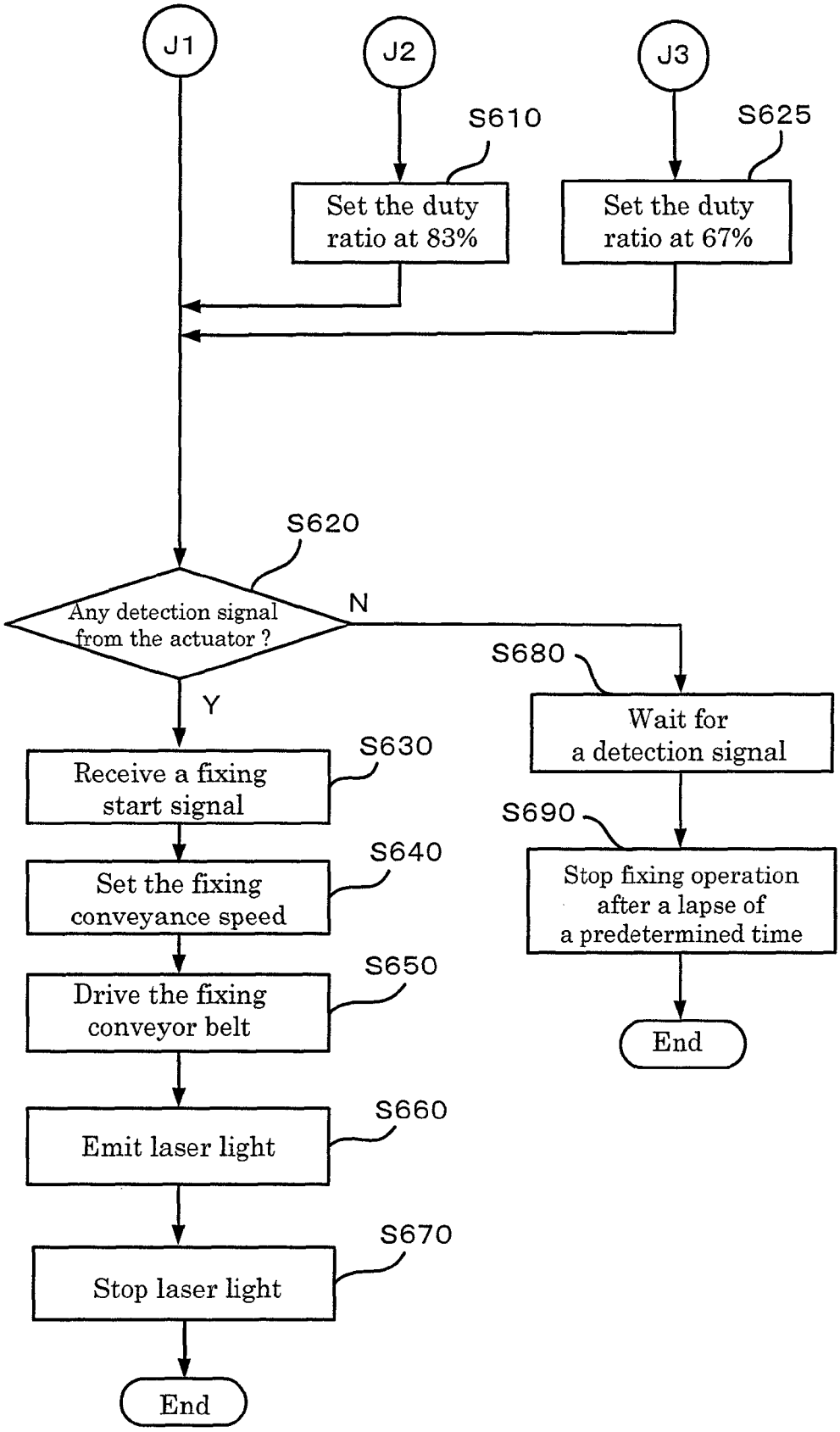
FIG. 10 is a flow chart showing the second half of the operation of fixing control in accordance with the duty ratio in the image forming apparatus according to the first embodiment.

FIGS. 9 and 10 show a flow chart of fixing control based on the duty ratio of the laser irradiator. The point of the flow chart herein different from the flow chart of the fixing control based on toner concentration shown in FIGS. 5 and 6, resides in Steps 590 to 625. Since the other control is the same as that of the flow chart of the fixing control based on toner concentration shown in FIGS. 5 and 6, description is omitted.

When toner concentration Tn falls within the range from 4% to lower than 6% (Step 580, Y), controller 11 transmits a signal to fixing controller 24 so as to set the duty ratio of the laser irradiator at 100% (Step 590).

On the other hand, when toner concentration Tn does not fall within the range from 4% to lower than 6% (Step 580, N), controller 11 determines whether toner concentration Tn falls within the range from 4% to lower than 8% (Step 600). When toner concentration Tn falls within the range from 4% to lower than 8% (Step 600, Y), the control goes through Jump J2 in FIG. 9 and controller 11 transmits a signal to fixing controller 24 so as to set the duty ratio of the laser irradiator at 83% (Step 610).

On the other hand, when toner concentration Tn does not fall within the range from 4% to lower than 8% (Step 600, N), the controls goes through Jump J3 in FIG. 9 and controller 11 transmits a signal to fixing controller 24 so as to set the duty ratio of the laser irradiator at 67% (Step 625).

In the above way, it is possible to control the energy E to be applied to fix the unfixed toner image by changing the duty ratio of the laser irradiator in accordance with the toner concentration.

<Evaluation on Fixing Performance Depending on Toner Concentration>

The image forming operation on the recording mediums (paper) in the image forming apparatus according to the first embodiment was performed with a fixing conveyance speed of 200 mm/s, a laser light irradiating width (the distance in the paper conveying direction in which the toner can receive laser light) of 0.08 mm, under an ambient temperature and humidity of 25 deg. C. and 5%, respectively, and fixing performance was evaluated for different levels of toner concentration (4%, 7% and 10%).

FIG. 11 is a table chart showing evaluation result of experimental data of fixing control depending on toner concentration. The experiment on fixing performance was carried out for different levels of toner concentration (4%, 7% and 10%). Here, to evaluate fixing performance, a solid image was printed with developers having a different toner concentration (4%, 7%, 10%), and a blank paper was put on the printed image surface and a weight (a 10 cm×10 cm 1 kgf load) was placed over the blank paper so as to examine whether the toner transfers from the printed image surface to the surface of the blank paper in the contact area therebetween. Fixing performance, either good or bad, was determined based on this examination. As the evaluation criteria of this experiment, fixing is evaluated as bad (X) when some toner adheres while fixing is evaluated as good (○) when no toner adheres.

In the table chart of experimental data in FIG. 11, the output level W of laser irradiator L1, toner concentration (4%, 7%, 10%) and fixing performance are given as evaluation items.

The image forming operation on the recording mediums (paper P) in the image forming apparatus according to the first embodiment was performed with the output level of laser irradiator L1 set at constant (e.g., 200 W), a laser light irradiating width (the distance in the paper conveying direction in which the toner can receive laser light) of 0.08 mm, under an ambient temperature and humidity of 25 deg. C. and 5%, respectively, and fixing performance was evaluated for different levels of toner concentration (4%, 7% and 10%), by changing the fixing conveyance speed.

In the table chart of experimental data in FIG. 12, fixing conveyance speed, toner concentration (4%, 7%, 10%) and fixing performance are given as evaluation items.

Also, the image forming operation on the recording mediums (paper) in the image forming apparatus according to the first embodiment was performed with the output level of laser irradiator L1 set at constant (e.g., 200W), the fixing conveyance speed set at constant (200 mm/s), a laser light irradiating width of 0.08 mm, under an ambient temperature and humidity of 25 deg. C and 5%, respectively, and fixing performance was evaluated for different levels of toner concentration (4%, 7% and 10%), by varying the duty ratio of laser irradiator L1.

In the table chart of experimental data in FIG. 13, the duty ratio, toner concentration (4%, 7%, 10%) and fixing performance are given as evaluation items.

Further, in order to examine the fixing performance depending on toner concentration (4%, 7%, 10%), the printed image surfaces with a solid image printed with each level of toner concentration (4%, 7%, 10%) were observed using an electron microscope.

Figure 14A:
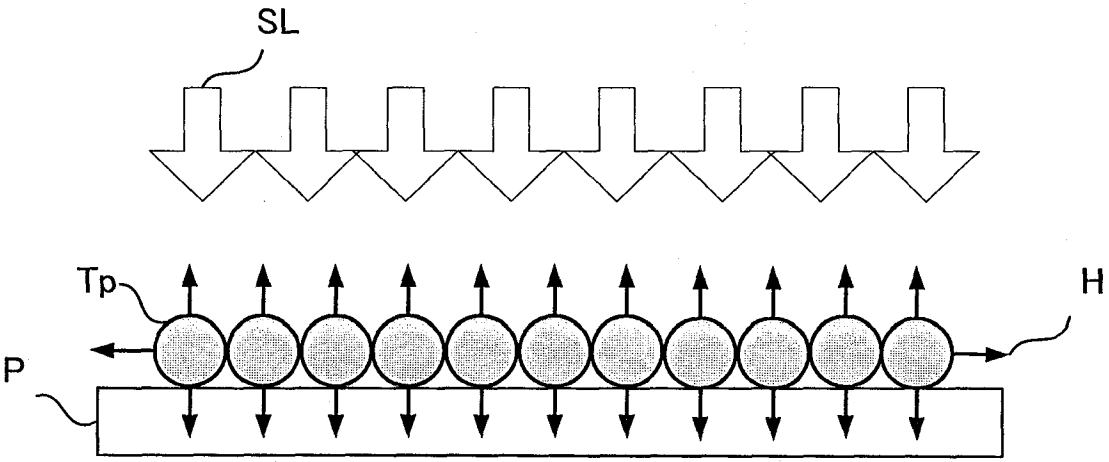
FIG. 14A is a diagram showing an example of a printed image surface when printing is performed with a developer having a toner concentration of 10% and FIG. 14B is a diagram showing an example of a printed image surface when printing is performed with a developer having a toner concentration of 4% or 7%.
Figure 14B:
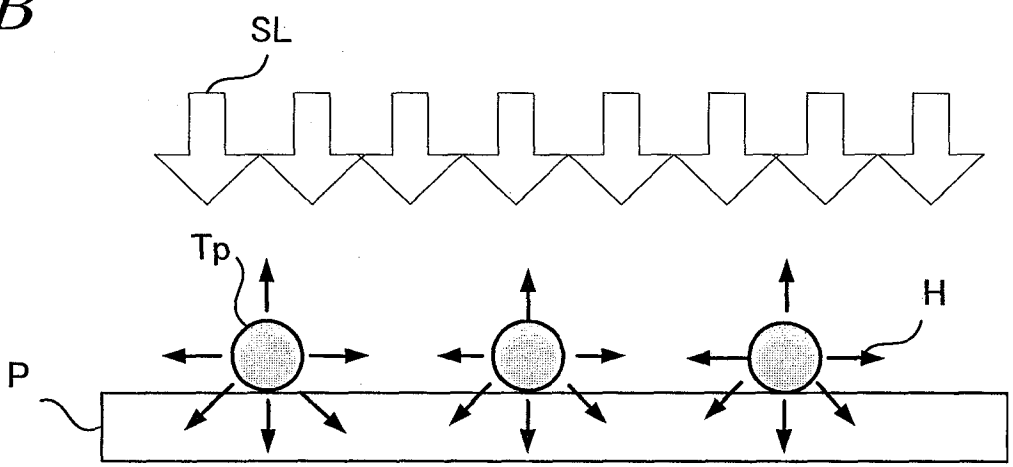

As shown in FIG. 14B, the spacing between toner particles was large on the printed image surface when printing was performed with a toner concentration of 4% or 7%. When each toner particle Tp absorbs laser light SL, the toner particle melts thanks to the absorbed heat. However, since there is spacing between toner particles, heat H escapes up, down, left and right, as indicated by the arrows. Accordingly, a large amount of energy is consumed for fixing when toner concentration is low. That is, due to high heat loss it is necessary to set the output level of laser light emitted from laser irradiator L1 at a high level.

On the other hand, as shown in FIG. 14A, toner particles were distributed compactly with little space on the printed image surface when printing was performed with a toner concentration of 10%. When each toner particle Tp absorbs laser light SL, heat H escapes up and down only since the adjacent toner particles serve as heat source to one another. Accordingly, when toner concentration is high, it is possible to achieve fixing with a lower energy compared to the case where toner concentration is low. That is, thanks to low heat loss the output level of laser light emitted from laser irradiator L1 can be low compared to the case where toner concentration is low.

<The Second Embodiment>

Figure 15:
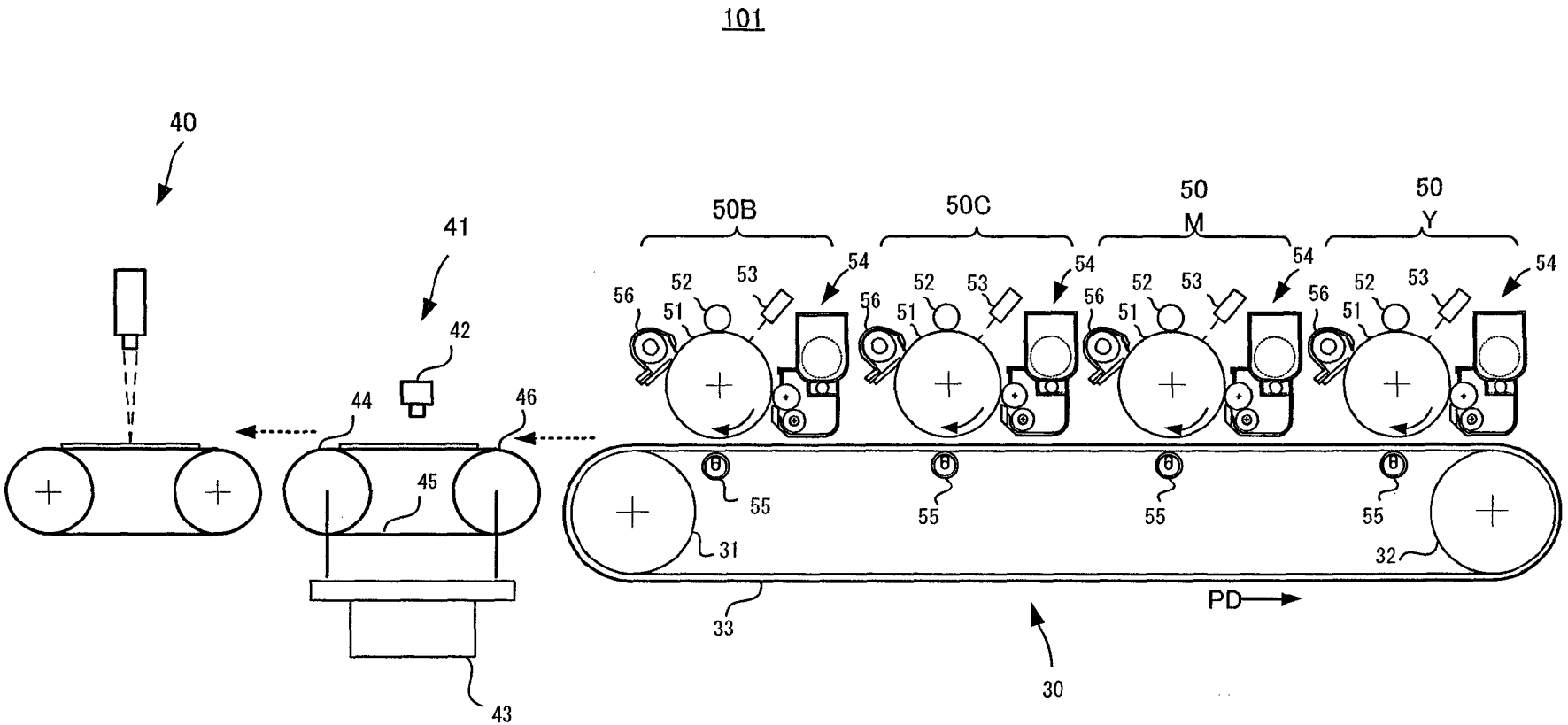
FIG. 15 is a schematic diagram showing a configuration of an image forming apparatus according to the second embodiment.

Next, an image forming apparatus 101 according to the second embodiment of the present invention will be detailed with reference to FIG. 15. FIG. 15 is a schematic diagram of image forming apparatus 101 according to the second embodiment of the present invention. Since the components in image forming apparatus 101 of the second embodiment are the same as those of the first embodiment except for a weight measuring unit 41, description of the components other than weight measuring unit 41 is omitted.

Now, fixing control of fixing device 40 of image forming apparatus 101 including weight measuring unit 41 will be described. Instead of toner concentration detector 54*b* according to the first embodiment, fixing control based on weight measuring unit 41 is performed in the second embodiment.

Even if an unfixed toner image is formed based on identical positional information on printing, the toner density and the amount of adherence (weight of the unfixed toner image per unit area) of the unfixed toner image may be different depending on the spread of toner (the way in which the toner layer is formed).

Figure 16A:
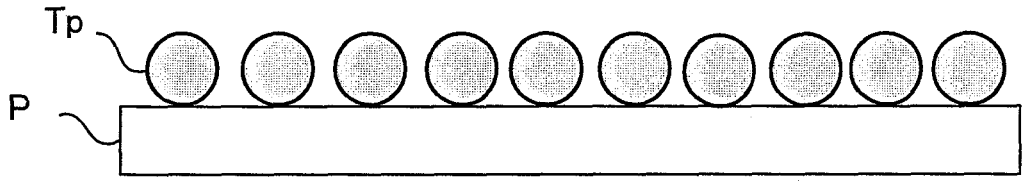
FIG. 16A is an exemplary diagram showing a state where toner particles forming an unfixed toner image are uniformly distributed and FIG. 16B is an exemplary diagram showing a state where toner particles forming an unfixed toner image are unevenly distributed.
Figure 16B:
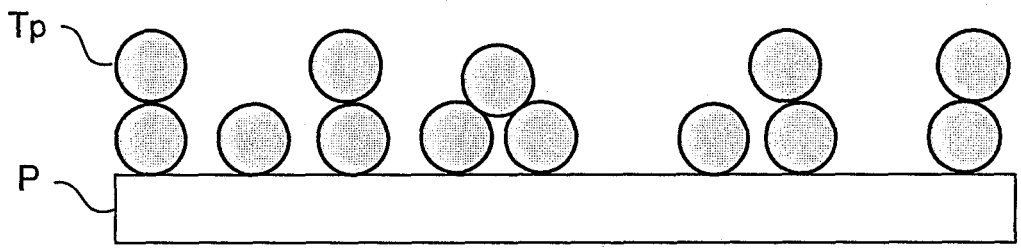

When toner particles Tp forming an unfixed toner image uniformly adhere on the recording medium (paper P) as shown in FIG. 16A, the toner coverage over paper P is high and it is possible to form a toner image of a desired toner density using a minimum amount of toner.

On the other hand, even when the same amount of toner as that in the above uniform case adheres, there may occur a case where an unfixed toner image is formed without toner particles Tp distributed uniformly on the recording medium (paper P). In this case, though the same amount of toner adheres, a toner image with unevenness in density is formed. The density of the unfixed toner image formed (the weight of the unfixed toner image per unit area) becomes lower compared to the case where toner particles adhere uniformly.

When the densities of unfixed toner images on the recording medium (paper P) (which will be referred to hereinbelow as unit area toner density information) before fixing are different, if the print coverage (positional information on printing) or the amount of toner adherence is identical, the necessary output level and energy consumption of the laser irradiator for heating to melt individual toner particles become different because the amount of heat absorbed by each toner particle is different from that of another.

In view of the above, the fixing operation in the second embodiment is controlled in accordance with the print coverage (positional information on printing), unit area toner density information or the toner weight of the unfixed toner image.

Weight measuring unit 41 of image forming apparatus 101 according to the second embodiment is a measuring unit that is arranged on the downstream of intermediate transfer belt unit 30 and upstream of fixing device 40 and measures the weight (paper weight information) of the recording medium (paper P) on which an unfixed toner image before fixing has adhered, and also optically detects the density (unit area toner density information) of the unfixed toner image.

Weight measuring unit 41 includes a measurement conveyor belt 45, a measurement drive roller 44 a measurement driven roller 46, an image density detector 42, a weight detector 43 and a second actuator 47.

Storage 12 has stored in advance a unit area toner density information table for determining the output level of laser irradiator L1 based on unit area toner density information. Storage 12 also has stored in advance the weights of black paper of different sizes.

Measurement conveyor belt 45 is an endless belt composed of a resin such as polycarbonate, vinylidene fluoride, polyimide or the like in which conductive materials such as carbon and the like are dispersed. Measurement conveyor belt 45 is tensioned between measurement drive roller 44 and measurement driven roller 46. Measurement drive roller 44 is connected to an unillustrated drive motor and is rotationally driven based on control signals from controller 11.

When paper P is separated from intermediate transfer belt 33 of intermediate transfer belt unit 30 and detected by second actuator 47 of weight measuring unit 41, a measurand paper detection signal is transmitted to controller 11.

As controller receives the measurand paper detection signal, it transmits a signal (measurement start signal) for instructing the start of measurement to image density detector 42 and weight detector 43.

Image density detector 42 is a measuring unit that detects the density (unit area toner density information) of the unfixed toner image on the recording medium (paper P) before fixing. When receiving the measurement start signal, image density detector 42 detects the reflected light intensity from the toner image formed on paper P and transmits the detected output value to controller 11.

Weight detector 43 is a measuring unit that detects the weight (paper weight information) of paper P with the unfixed toner image before fixing thereon. When receiving the measurement start signal, weight detector 43 transmits the measured paper weight information to controller 11.

Figure 17:
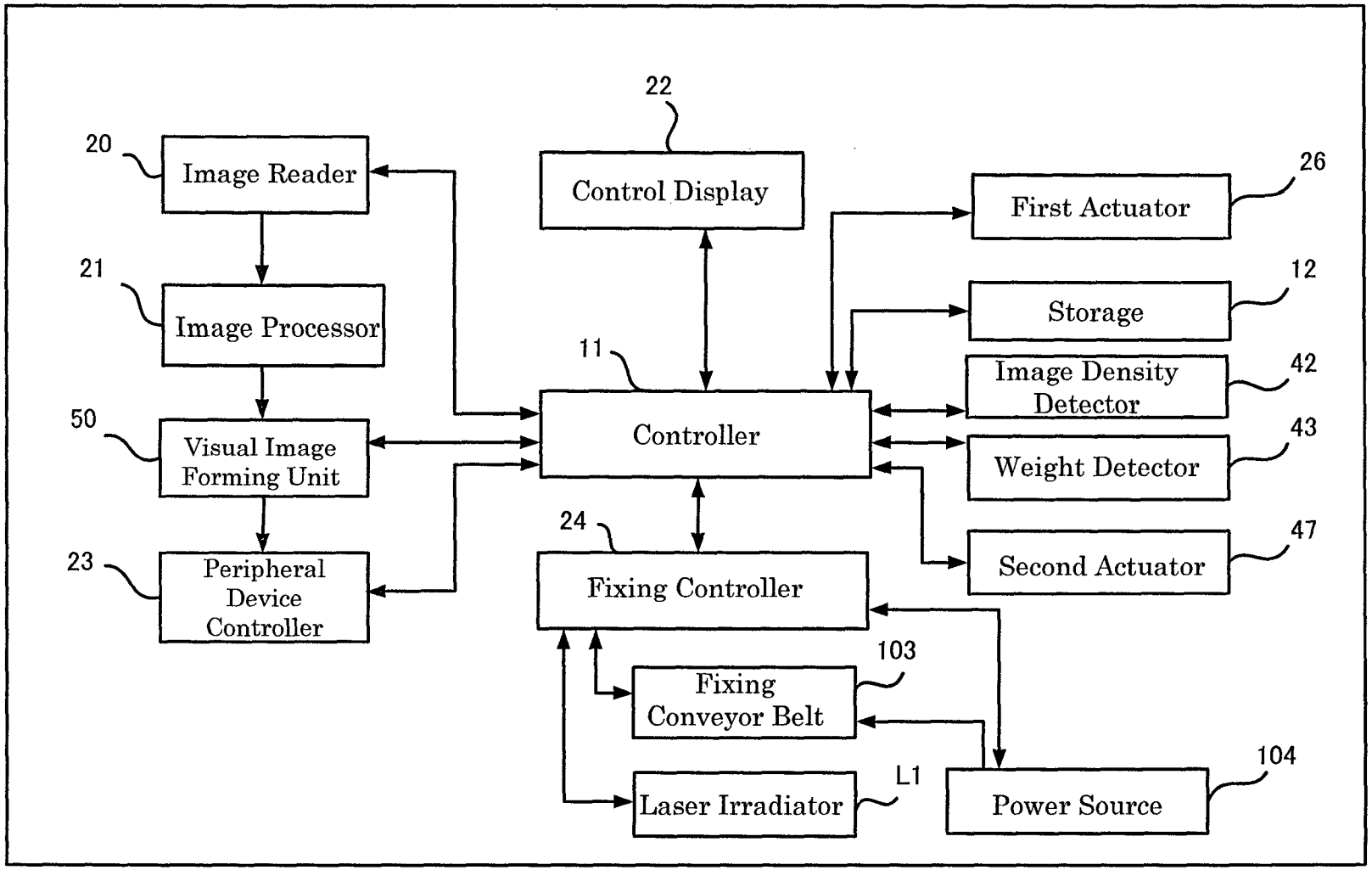
FIG. 17 is a block diagram showing a configuration of an image forming apparatus according to the second embodiment.

As shown in FIG. 17, controller 11 compares the transmitted output value (unit area toner density information) from image density detector 42 with the reference density value or the target value previously stored in storage 12, and also compares the transmitted paper weight information from weight detector 43 with the reference weight value of the paper free from an unfixed toner image, previously stored in storage 12.

Controller 11 obtains information on printing positions (positional information on printing) for determining the positions to be printed in every page, in other words, the print coverage or the area ratio between the area to be printed on the paper and the area free from printing based on the read image data, from image processor 21.

Controller 11, based on the above result of comparison and the coverage ratio, determines the output level of laser irradiator L1 of fixing device 40.

Here, weight measuring unit 41 may also be configured so as to store the weight (paper weight information) of the paper P measured first and compare the weight of the paper passing second or after with the first one, to thereby determine the difference in weight.

Paper P is separated from measurement conveyor belt 45 thanks to the curvature of measurement drive roller 44 and conveyed to fixing device 40.

Controller 11 transmits a control signal (fixing start signal) to fixing controller 24 so that laser irradiator L1 will emit laser light based on the determined output level.

Fixing controller 24, receiving the control signal (fixing start signal), controls the power of laser light emitted from laser irradiator L1. Here, fixing controller 24 may also be configured so as to control irradiation of laser light by controlling the fixing unit motor (not shown) to set an appropriate paper conveying speed. Alternatively, the drive time ratio (duty ratio) of laser light emitted from laser irradiator L1, in association with print coverage (positional information on printing), unit area toner density information and paper weight information, has been stored in advance in storage 2, so that fixing controller 24 may control the laser light emitted from laser irradiator L1 based on the duty ratio.

Laser irradiator L1, based on the control of fixing controller 24, irradiates the unfixed toner image on paper P with laser light. Heat of laser light performs fixing.

Since the energy used for laser light irradiation in fixing device 40 is controlled by taking into account the density and toner weight of the unfixed toner image formed on the recording medium (paper P) before fixing, it is possible to prevent waste consumption of energy for emitting laser light.

<Evaluation on Fixing Performance of Unfixed Toner Images at Different Densities>

The image forming operation on the recording mediums (paper) in image forming apparatus 101 according to the second embodiment was performed with a fixing conveyance speed of 200 mm/s, a laser light irradiating width (the distance in the paper conveying direction in which the toner can receive laser light) of 0.08 mm, a print coverage of 100% (solid image), using 100 sheets of A4 size paper, under an ambient temperature and humidity of 25 deg. C. and 5%, respectively, and fixing performance depending on the density of the unfixed toner image was evaluated. Here, to evaluate fixing performance, a solid toner image having a density of from 1.5 to 1.0 in their unfixed condition is printed, and a blank paper is put on the printed image surface of the resultant printed image and a weight (a 10 cm×10 cm 1 kgf load) is placed over the blank paper so as to examine whether the toner transfers from the printed image surface to the surface of the blank paper in the contact area therebetween. Fixing performance, either good or bad, is determined based on this examination. As the evaluation criteria of this experiment, fixing is evaluated as bad when some toner adheres while fixing is evaluated as good when no toner adheres.

The output level W of laser light emitted from laser irradiator L1 increases as the number of paper fixed increases, as shown in FIG. 18. Observing the first and 100th sheets as to the amount of toner adherence F, the amounts of toner adherence for those were both 0.4 mg/cm$^2$. The fixing performance of the first sheet was evaluated as being good, whereas the 100th sheet was evaluated as being bad.

Further, observing the first and 100th sheets by means of an electron microscope, the toner particles on the surface of the first sheet were uniformly distributed as shown in FIG. 16A, whereas the toner particles on the surface of the 100th sheet were overlapped in several places and left some empty areas, forming bumpy texture as a whole on the enlarged surface.

Further, the density of the unfixed toner image was measured every predetermined number of sheets (on 1st, 20th, 40th, 60th, 80th and 100th sheets) and compared with associated output level (W) of laser light emitted from laser irradiator L1. As a result, it was understood that the output level of laser light is increased as the density of the unfixed toner image lowers.

Next, fixing performance was evaluated with a constant print coverage by varying the amount of toner adherence (0.5 mg/cm$^2$, 0.6 mg/cm$^2$, 0.7 mg/cm$^2$) every predetermined number of sheets (on 1st, 20th, 40th, 60th, 80th and 100th sheets), with reference to the density (1.5 to 1.0) of the unfixed toner image and the output level (W) of laser light emitted from laser irradiator L1. Here, the amount of toner adherence is calculated based on the weight (paper weight information) of the recording medium (paper P) to which the unfixed toner image before fixing adheres.

The output level W of laser light emitted from laser irradiator L1 increases as shown in FIG. 19 as the amount of toner adherence F and the unfixed toner image density D (1.5 to 1.0) increases.

As a result, it was understood that the output level (W) of laser light emitted from laser irradiator L1 becomes different as the amount of toner adherence and the unfixed toner image density change even with a constant print coverage, hence the energy consumed during a fixing operation also becomes different.

The data as shown in FIG. 19 has been stored in advance into storage 12, so that it is possible to provide the optimal output level (W) of laser light without waste, based on the print coverage, unfixed toner image density and paper weight information.

Further, FIG. 20 is a table chart showing the relationship between the unfixed toner image density (1.5 to 1.0) and the irradiation time of laser irradiator L1 at every predetermined number of sheets (on 1st, 20th, 40th, 60th, 80th and 100th sheets) when printing was performed with a constant print coverage by varying the amount of toner adherence (0.5 $mg/cm^2$, 0.6 $mg/cm^2$, 0.7 $mg/cm^2$).

Moreover, FIG. 21 is a table chart showing the paper conveyance speed corresponding to the irradiation time of laser irradiator L1 in the above experiment. It is also possible to control the output of laser light of laser irradiator L1 by storing the above data into storage 12, in advance.

Furthermore, in the image forming operation on the recording mediums (paper P) in image forming apparatus 101 according to the second embodiment, performed with a constant output level of laser irradiator L1 (e.g., 200 W), a constant fixing conveyance speed (e.g., 200 mm/s), a laser light irradiating width of 0.08 mm under an ambient temperature and humidity of 25 deg. C. and 5%, respectively, it is also possible to control the output of laser light of laser irradiator L1 by controlling the duty ratio of laser irradiator L1 in accordance with the unfixed toner density (1.5 to 1.0) and the amount of toner adherence (0.5 $mg/cm^2$, 0.6 $mg/cm^2$, 0.7 $mg/cm^2$) based on the table chart shown in FIG. 22. Here, the percent notation in FIG. 22 represents duty ratios. Examples of duty ratios of 50 and 25% are shown in FIGS. 23A and 23B, respectively.

Controlling the output of laser irradiator L1 in the fixing device based on the duty ratio in the above way can simplify the configuration of laser irradiator L1, hence making it possible to miniaturize fixing device 40 and image forming apparatus 101.

What is claimed is:

1. An image forming apparatus comprising:

a fixing device including a laser irradiator emitting laser light onto a recording medium being conveyed to thermally fix an unfixed toner image onto the recording medium;

a controller controlling image formation;

a developing device performing development using a dual-component developer including a toner and a carrier;

a toner concentration detector detecting the toner concentration in the developing device; and, a storage storing the toner concentration and a reference toner concentration, characterized in that the controller compares the toner concentration detected by the toner concentration detector with the reference toner concentration, calculates the output level of the laser irradiator, controls the laser irradiator based on the calculation, controls to increase the output level of the laser irradiator in accordance with the detected toner concentration when the toner concentration is lower than the reference toner concentration, and controls to lower the output level of the laser irradiator in accordance with the detected toner concentration when the toner concentration is higher than the reference toner concentration.

2. The image forming apparatus according to claim 1, wherein the controller keeps the output level of the laser irradiator constant, controls the irradiation time of the laser irradiator to be longer in accordance with the detected toner concentration when the toner concentration is lower than the reference toner concentration and controls the irradiation time of the laser irradiator to be shorter in accordance with the detected toner concentration when the toner concentration is higher than the reference toner concentration.

3. An image forming apparatus comprising:

a fixing device including a laser irradiator emitting laser light onto a recording medium being conveyed to thermally fix an unfixed toner image onto the recording medium;

a controller controlling image formation;

a printing information detector acquiring printing information that determines the positions of printing on the recording medium;

a weight detector arranged upstream of the fixing device for measuring the weight of the recording medium with toner adhering thereto before fixing to obtain weight information; and a storage storing the printing information and the weight information, characterized in that the controller controls the output of the laser irradiator based on the printing information and the weight information, and wherein the weight detector includes a density detector that detects unit toner density as the toner weight per predetermined unit area in the recording medium to acquire unit area toner density information, and the controller controls the output of the laser irradiator based on the printing information, the weight information and the unit area toner density information.

4. The image forming apparatus according to claim 3, wherein the controller keeps the output level of the laser irradiator constant, controls the irradiation time of the laser irradiator to be longer in accordance with the detected unit area toner density information when the unit area toner density information is lower than a predetermined value and controls the irradiation time of the laser irradiator to be shorter in accordance with the detected unit area toner density information when the unit area toner density information is higher than a predetermined value.

* * * * *